US007530874B2

(12) United States Patent
Hataoka et al.

(10) Patent No.: US 7,530,874 B2
(45) Date of Patent: May 12, 2009

(54) METHOD FOR MANUFACTURING HIGH PRESSURE DISCHARGE LAMP, HIGH PRESSURE DISCHARGE LAMP MANUFACTURED USING THE METHOD, LAMP UNIT, AND IMAGE DISPLAY DEVICE

(75) Inventors: Shinichiro Hataoka, Katano (JP); Kiyoshi Takahashi, Kyotanabe (JP); Jun Sakaguchi, Takatsuki (JP); Yoshitaka Kurimoto, Takatsuki (JP); Syunsuke Ono, Takatsuki (JP); Takashi Tsutatani, Otsu (JP); Tomoyuki Seki, Takatsuki (JP); Makoto Horiuchi, Sakurai (JP); Tsuyoshi Ichibakase, Takatsuki (JP)

(73) Assignee: Panasonic Corporation, Osaka (JP)

( * ) Notice: Subject to any disclaimer, the term of this patent is extended or adjusted under 35 U.S.C. 154(b) by 511 days.

(21) Appl. No.: 11/234,317

(22) Filed: Sep. 26, 2005

(65) Prior Publication Data

US 2006/0035558 A1 Feb. 16, 2006

Related U.S. Application Data

(63) Continuation of application No. PCT/JP2004/003521, filed on Mar. 17, 2004.

(30) Foreign Application Priority Data

Mar. 27, 2003 (JP) ..... 2003-088414
Mar. 28, 2003 (JP) ..... 2003-091201

(51) Int. Cl.
*H01J 9/44* (2006.01)

(52) U.S. Cl. ..... 445/5

(58) Field of Classification Search ..... 445/5, 445/24, 59; 313/627, 634
See application file for complete search history.

(56) References Cited

U.S. PATENT DOCUMENTS 4,545,799 A * 10/1985 Rhodes et al. ..... 65/59.21
5,096,479 A 3/1992 Allen et al.
5,109,181 A 4/1992 Fischer et al.

(Continued)

FOREIGN PATENT DOCUMENTS

EP 0 903 771 A2 3/1999

(Continued)

OTHER PUBLICATIONS

Database WPI Week 198736, Derwent Publications Ltd., London, GB; AN 1987-255869, XP002432802 & SU 1 285 543 A (Light Source Eng) Jan. 23, 1987 *abstract; figures*.

*Primary Examiner*—Joseph L Williams
*Assistant Examiner*—Hana A Sanei
(74) *Attorney, Agent, or Firm*—Wenderoth, Lind & Ponack, L.L.P.

(57) ABSTRACT

A method for manufacturing a high pressure mercury lamp having a high pressure resistance strength includes an electric field application step of applying an electric field to at least a light emitting part while keeping the high pressure mercury lamp at a high temperature. As a result of the electric field application step, impurities such as hydrogen and an alkali metal existing in a discharge space and in glass used for forming the light emitting part (1) and sealing parts (2) can be reduced, with it being possible to suppress blackening and devitrification during lighting.

20 Claims, 31 Drawing Sheets

U.S. PATENT DOCUMENTS

| | | | | |
|---|---|---|---|---|
| 6,232,719 | B1 | 5/2001 | Kaneko et al. | |
| 6,232,720 | B1 * | 5/2001 | Kitahara et al. | 313/634 |
| 6,597,114 | B1 | 7/2003 | Tagawa et al. | |
| 6,597,118 | B2 | 7/2003 | Arimoto et al. | |
| 2002/0047611 | A1 * | 4/2002 | Kaneko et al. | 315/246 |
| 2002/0180358 | A1 | 12/2002 | Kobayakawa et al. | |
| 2007/0052365 | A1 | 3/2007 | Sakaguchi et al. | |

FOREIGN PATENT DOCUMENTS

| | | | |
|---|---|---|---|
| EP | 1172841 | | 1/2002 |
| EP | 1 607 997 | A1 | 12/2005 |
| JP | 40-8397 | | 4/1965 |
| JP | 6-310100 | | 11/1994 |
| JP | 10-134773 | | 5/1998 |
| JP | 2829339 | | 9/1998 |
| JP | 2000-182566 | | 6/2000 |
| JP | 2000-195468 | | 7/2000 |
| JP | 2001-266797 | | 9/2001 |
| JP | 3385014 | | 12/2002 |

* cited by examiner (TABLE 1)

| LAMP | CONVENTIONAL SAMPLE (WITHOUT ELECTRIC FIELD) | | PRESENT INVENTION SAMPLE (WITH ELECTRIC FIELD) | |
|---|---|---|---|---|
| MEASUREMENT LOCATION | LIGHT EMITTING PART | SEALING PART | LIGHT EMITTING PART | SEALING PART |
| Na CONTENT(ppm) | 0.61 | 0.44 | 0.11 | 0.70 |

FIG.24

(TABLE 2)

| | AFTER 300 HOURS OF LIGHTING | | | AFTER 2000 HOURS OF LIGHTING | | |
|---|---|---|---|---|---|---|
| | BLACKENING | DEVITRIFICATION | ILLUMINANCE MAINTENANCE FACTOR (%) | BLACKENING | DEVITRIFICATION | ILLUMINANCE MAINTENANCE FACTOR (%) |
| PRESENT INVENTION SAMPLE | ABSENT | ABSENT | 98 | ABSENT | ABSENT | 74 |
| COMPARATIVE SAMPLE | PRESENT | PRESENT | 85 | — | — | — |

FIG.25

(TABLE 3)

| | | ILLUMINANCE MAINTENANCE FACTOR (%) | | JUDGMENT |
|---|---|---|---|---|
| | | AFTER 1000 HOURS OF LIGHTING | AFTER 2000 HOURS OF LIGHTING | |
| APPLIED VOLTAGE | 0V | 70 | — | BAD |
| | −25V | 71 | — | BAD |
| | −50V | 82 | 60 | GOOD |
| | −100V | 89 | 75 | GOOD |
| | −200V | 92 | 78 | GOOD |

METHOD FOR MANUFACTURING HIGH PRESSURE DISCHARGE LAMP, HIGH PRESSURE DISCHARGE LAMP MANUFACTURED USING THE METHOD, LAMP UNIT, AND IMAGE DISPLAY DEVICE

This is a continuation of PCT application No. PCT/JP2004/003521 filed on Mar. 17, 2004.

BACKGROUND OF THE INVENTION

1. Field of the Invention

The present invention relates to a method for manufacturing a high pressure discharge lamp having a high luminous flux maintenance factor and a long life, a high pressure discharge lamp manufactured using this method, a lamp unit, and an image display device.

2. Description of the Related Art

In recent years, projection-type image display devices such as a liquid crystal projector and a DMD (Digital Micromirror Device) projector are widely used as systems that realize large-screen images. High pressure discharge lamps having high luminance, especially high pressure mercury lamps, are often employed as light sources of such image display devices (see Japanese Patent Application Publication No. H02-148561 as one example).

FIG. 1 shows a construction of a high pressure mercury lamp 1000 disclosed by the above publication.

In the drawing, the high pressure mercury lamp 1000 has a light emitting part 501 which is mainly made of quartz, and one pair of sealing parts 502 extending from both sides of the light emitting part 501. A metal electrode structure is sealed in each of the sealing parts 502, to make the inside of the light emitting part 501 airtight while allowing power to be supplied from outside into the light emitting part 501.

The electrode structure is formed by electrically connecting an electrode 503 made of tungsten (W), amolybdenum (Mo) foil sheet 504, and an external lead 505 in this order. A coil 512 is wound around a tip of the electrode 503.

Mercury (Hg), which is a light emitting material, argon (Ar), and a small amount of halogen gas are enclosed inside the light emitting part 501.

When a starting voltage is applied to the ends of the pair of external leads 505 of this high pressure mercury lamp 1000, a discharge of Ar occurs and the temperature in the light emitting part 501 increases. As a result of this temperature increase, Hg atoms evaporate and occupy the inside of the light emitting part 501 in gaseous form. During this time, though an Hg vapor pressure reaches as high as 15 MPa to 20 MPa, the airtightness can be maintained by the molybdenum foil sheets 504 in the sealing parts 502 (foil sealing structure).

There is a growing tendency to increase a charged pressure of mercury in such a constructed high-pressure mercury lamp 1000, in order to achieve a longer life and higher luminance.

However, when the charged pressure of mercury is increased, the molybdenum foil and the quartz glass in the sealing part 502 peel away from each other as over time, due to factors such as a difference in thermal expansion coefficient between the two materials. This causes a leakage of the substances enclosed in the light emitting part 501.

To solve this problem, Japanese Patent Application Publication No. 2002-93361, as one example, discloses a construction in which sealing is performed with an additional member, formed by adding a raw material such as copper oxide (CuO) or aluminum oxide ($Al_2O_3$) to silica ($SiO_2$), being interposed between a portion of an electrode rod of the electrode located in the sealing part and the quartz glass which forms the sealing part. This produces greater adhesiveness between the sealing part and the electrode structure in an area where the additional member is provided. As a result, the molybdenum foil and the quartz glass do not peel away from each other, and leakage is thereby prevented.

Also, Japanese Patent Application Publications Nos. 2000-182566 and 2000-195468, for example, disclose high pressure mercury lamps in which the electrode structure is sealed in the sealing part through a functionally gradient material being interposed therebetween, thereby being able to withstand greater pressures.

FIG. 2 is a partial cutaway view showing a construction of a high pressure mercury lamp disclosed in Japanese Patent Application Publication No. 2000-182566. As illustrated, a block member 523 made of a functionally gradient material is fixed in each of two side tube parts 522 that extend from both sides of an arc tube 521 made of quartz glass, and a feeder 524 is sealed near an outer end of this block member 523.

The functionally gradient material referred to here is a material that has different thermal expansion coefficients in different portions. In the example of FIG. 2, the thermal expansion coefficient of the block member 523 is closer to that of quartz glass in a portion nearer the side tube part 522, and closer to that of a metal which forms the feeder 524 in a portion nearer the outside. In more detail, the block member 523 contains molybdenum as a conductive ingredient and silica as a nonconductive ingredient. One end of the block member 523 opposite to the arc tube 521 is rich with molybdenum and therefore conductive. Silica content increases in a continuous or stepwise manner in a direction toward the arc tube 521, such that the end of the block member 523 nearest the arc tube 521 is rich with silica and therefore nonconductive.

Such a block member 523 reduces the thermal stress which occurs in the contact area between different materials in the sealing part due to the difference in the thermal expansion coefficients of the different materials, to thereby suppress cracking and the like. In this way, the pressure resistance strength in the sealing part is enhanced.

Both of the above constructions, i.e. the sealing of the electrode structure via the additional member containing copper oxide or the like and the sealing of the electrode structure via the functionally gradient material member, certainly improve the pressure resistance strength in the sealing part and contribute to higher luminance of the high pressure mercury lamp. According to these constructions, however, blackening and devitrification tend to occur in the light emitting part during lighting, which shortens the service life of the high pressure mercury lamp.

This problem can be attributed to the following. Both the additional member containing copper oxide or the like and the functionally gradient material member inevitably contain impurities by their nature. When manufacturing or lighting the high pressure mercury lamp, such impurities unavoidably enter into a discharge space inside the light emitting part.

The impurities which have entered into the discharge space may react with quartz glass forming the inner wall of the light emitting part, especially in a high temperature area. This leads to devitrification. Also, the impurities, and in particular an alkali metal, may ionize and bind to a halogen which is enclosed in the discharge space. As a result, a halogen cycle cannot work properly, and tungsten evaporating from the electrode deposits itself on the inner wall of the light emitting part. This leads to blackening.

Efforts have been made to prevent impurities which are contained in the sealing part from entering into the light emitting part in the high-pressure mercury lamp, but no decisive solution has yet been proposed. This problem can occur not only in the high pressure mercury lamps but also in high pressure discharge lamps having sealing parts in general.

The present invention was conceived to solve the above problem, and aims to provide a method for manufacturing a high-pressure discharge lamp in which a functionally gradient material or an additional material, e.g. quartz glass with an additive, is disposed in a sealing part to increase a pressure resistance strength, such that the occurrence of blackening and devitrification in a light emitting part can be suppressed by removing impurities from a discharge space in the light emitting part in a simple manner. The present invention also aims to provide a high pressure discharge lamp manufactured using this method, a lamp unit, and an image display device.

BRIEF SUMMARY OF THE INVENTION

The stated aim can be achieved by a method for manufacturing a high pressure discharge lamp that includes: a light emitting part which is formed from glass and in an internal space of which a pair of electrodes are provided and a light emitting material is enclosed; and a sealing part which keeps the internal space of the light emitting part airtight by sealing a pair of feeders, which are respectively connected to the pair of electrodes, in a first member that connects with the light emitting part, the method including: a sealing step of sealing the pair of feeders in the first member, with a second member being interposed between the first member and each feeder so as to surround at least one portion of the feeder; and an electric field application step of applying an electric field to the light emitting part, while keeping the light emitting part at no lower than a temperature that is required for impurities existing in the internal space of the light emitting part to diffuse into the glass which forms the light emitting part.

As a result of the electric field application step, impurities which are present inside the light emitting part are moved by electrostatic force of an electric field applied from outside, so as to enter into the glass which forms the light emitting part. The impurities may then pass through the glass and are released outside the light emitting part. In this way, the amount of impurities inside the light emitting part can be minimized, with it being possible to suppress blackening and devitrification. Hence a high pressure discharge lamp with a higher illuminance maintenance factor and a longer life can be realized.

Here, "the feeder" is a conductive member for supplying power to an electrode. The feeder can be realized not only by a metal foil sheet but also in various fashions depending on the form of an electrode structure located in the sealing part. In some cases, the feeder may be an electrode rod itself. Also, "to surround at least one portion of the feeder" does not necessarily mean that the second member is provided all around at least one portion of the feeder.

Here, when the glass that forms the light emitting part is quartz glass, in the electric field application step at least the light emitting part is desirably kept in a range of 600° C. to 1100° C.

The above method facilitates the ionization of impurities inside the light emitting part, as a result of which the impurities are more easily expelled from the discharge space in the light emitting part by the electric field.

A high pressure discharge lamp manufactured according to the above method has a long life, as the light emitting part is kept from devitrification and blackening. Such a high pressure discharge lamp may be combined with a concave reflecting mirror to form a lamp unit which can then be used as a light source of an image display device. Since this lamp unit need not be replaced frequently, maintenance costs can be reduced.

BRIEF DESCRIPTION OF DRAWINGS

FIG. 24 shows effects of the electric field application step performed by the device shown in FIG. 23.

FIG. 25 shows a result of an experiment of applying different voltages to each of conductive wires 51 and 52 in the electric field application step performed by the device shown in FIG. 23.

DETAILED DESCRIPTION OF THE INVENTION

The following describes embodiments of the present invention with reference to the drawings.

First Embodiment

The inventors of the present invention devised a new construction of a high pressure discharge lamp (including a high pressure mercury lamp) in which the pressure resistance of a sealing part is increased to cope with an increased pressure inside a light emitting part, and thereby achieve a higher pressure resistance strength. The inventors filed patent applications based on this construction (Japanese Patent Application No. 2002-351523 and Japanese Patent Application Publication No. 2003-234067).

This embodiment describes a method for manufacturing such a high pressure discharge lamp having a high pressure resistance strength and especially a high pressure mercury lamp, according to which blackening and devitrification in the light emitting part can be suppressed, thereby increasing lamp life.

(1) Construction of a High Pressure Mercury Lamp

Figure 1:
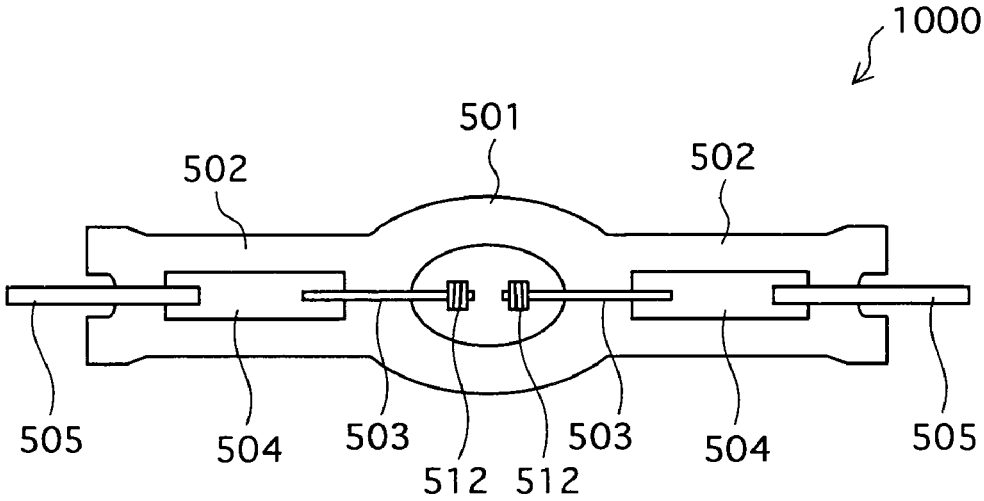
FIG. 1 is a representation of a construction of a conventional high pressure mercury lamp.
Figure 2:
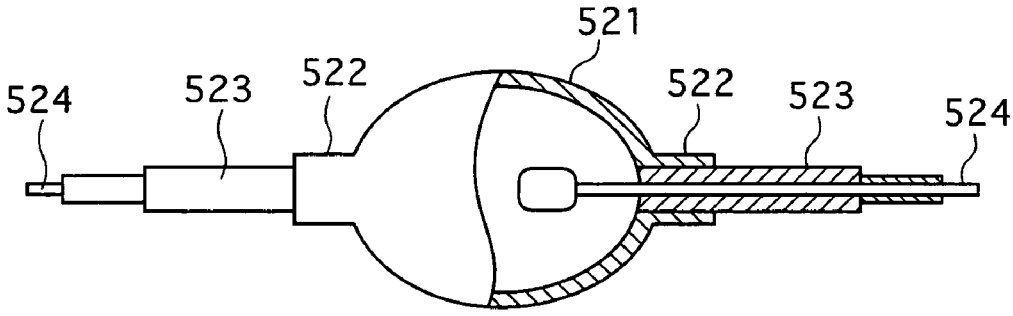
FIG. 2 is a representation of a construction of a conventional high pressure mercury lamp having a functionally gradient structure.
Figure 3A:
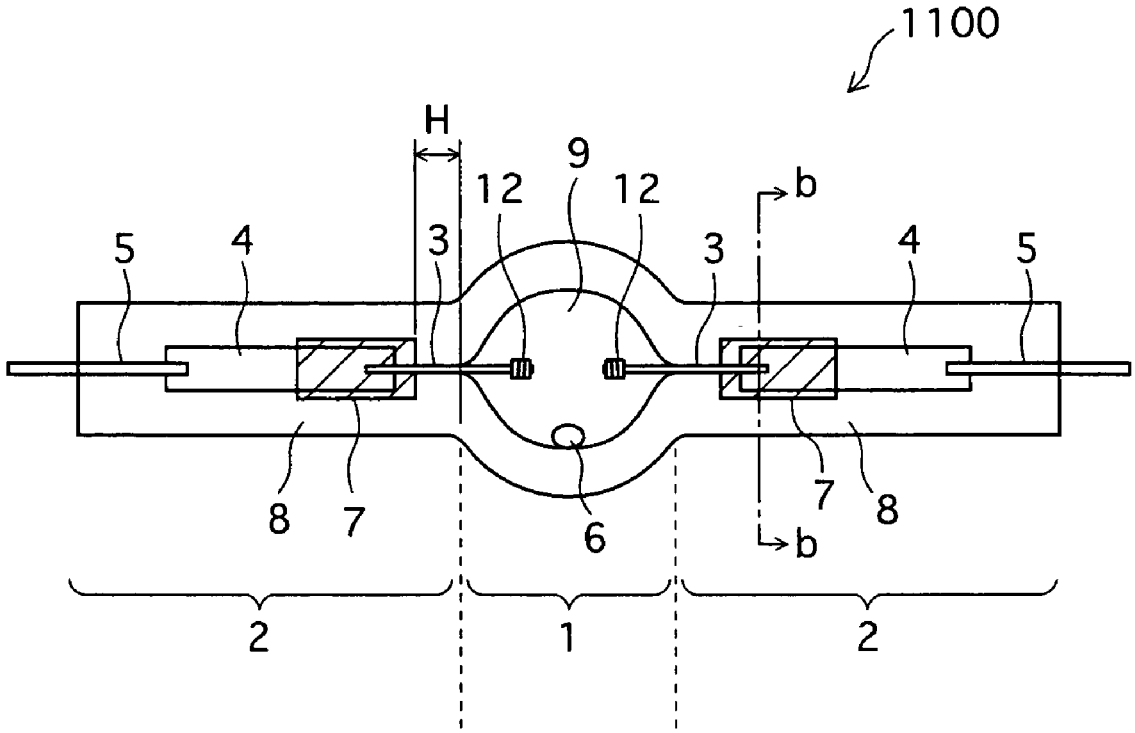
FIG. 3A is a front view of a high pressure mercury lamp 1100 to which embodiments of the present invention relate.
Figure 3B:
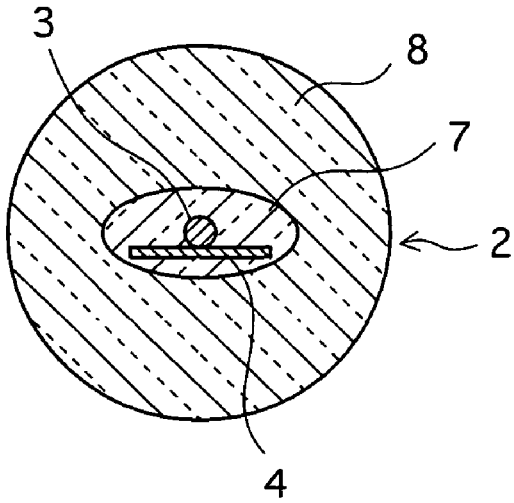
FIG. 3B is a cross sectional view taken along line b-b given in FIG. 3A.

FIGS. 3A and 3B show a construction of a high pressure mercury lamp 1100 (hereafter referred to as "lamp") according to this embodiment.

FIG. 3A is a schematic front view of an entire construction of the lamp 1100, whereas FIG. 3B is a schematic cross section of the lamp 1100 along line b-b in FIG. 3A. Although components such as electrodes and metal foil sheets located inside a light emitting part and sealing parts should be indicated by dashed lines in FIG. 3A, these components are indicated by solid lines to resemble an actual appearance, since the light emitting part and the sealing parts are made of a transparent glass material and therefore internal components can be seen (the same applies to other drawings similar to FIG. 3A, except FIG. 18).

The lamp 1100 is a double-end lamp provided with a light emitting part 1 inside which a light emitting material 6 is enclosed and two sealing parts 2 extending from the sides of the light emitting part 1.

As shown in FIG. 3A, the sealing parts 2 serve to keep the inside of the light emitting part 1 airtight. Each of the sealing parts 2 includes a first glass part (side tube part) 8 which extends from the light emitting part 1, and a second glass part 7 provided in at least part of the inside (in a central side) of the first glass part 8.

As shown in FIG. 3B, the sealing part 2 is substantially circular in cross section. A metal foil sheet (feeder) 4 made of molybdenum as one example is arranged in the sealing part 2 to supply lamp power. This metal foil sheet 4 is located substantially at a center of the sealing part 2, and is in contact with the second glass part 7 on its periphery. The second glass part 7 is located substantially at the center of the sealing part 2 too, and is in tight contact with an inner wall of the first glass part 8 on its periphery.

The light emitting part 1 is substantially spherical. In one exemplary embodiment, the light emitting part 1 has an outside diameter of about 5 mm to about 20 mm, and a glass thickness of about 1 mm to about 5 mm. The volume of a discharge space 9 in the light emitting part 1 is about 0.01 cc to about 1 cc (0.01 $cm^3$ to 1 $cm^3$).

Specifically, this embodiment employs the following dimensions for the lamp 1100: an outside diameter of about 10 mm; an inside diameter of about 5 mm; and a discharge space volume of about 0.06 cc. Also, a distance H from an end face of the second glass part 7 on the light emitting part 1 side to the discharge space 9 in the light emitting part 1 is about 1 mm.

Mercury 6 is enclosed in the light emitting part 1 as a light emitting material. When operating the lamp 1100 as an ultra-high pressure mercury lamp, about 200 mg/cc or more (e.g. no less than 220 mg/cc, no less than 230 mg/cc, or no less than 250 mg/cc) of mercury, and preferably about 300 mg/cc or more (e.g. 300 mg/cc to 500 mg/cc) of mercury is enclosed in the light emitting part 1 as the mercury 6, together with a rare gas (e.g. argon) of 5 kPa to 30 kPa and, according to need, a small amount of halogen.

The halogen enclosed in the light emitting part 1 produces a halogen cycle that returns W (tungsten), which has evaporated from an electrode rod 3, back to the electrode rod 3 during lamp operation. For example, bromine (Br) is used as the halogen.

The halogen enclosed here may be a simple substance or a halogen precursor (a compound). In this embodiment, the halogen is enclosed in the form of $CH_2Br_2$.

In this embodiment, an amount of $CH_2Br_2$ enclosed in the light emitting part 1 is about 0.0017 mg/cc to about 0.17 mg/cc. This is equivalent to about 0.01 μmol/cc to about 1 μmol/cc when converted to a halogen atom density during lamp operation. According to this embodiment, the lamp 1100 can exhibit a pressure resistance strength (operating pressure) of at least 20 MPa, preferably about 30 MPa to about 50 MPa, or more.

Meanwhile, bulb wall loading is, for example, about 60 $W/cm^2$ or more, and has no specific upper limit. As one example, a lamp with bulb wall loading in a range of about 60 $W/cm^2$ to about 300 $W/cm^2$ (preferably about 80 $W/cm^2$ to about 200 $W/cm^2$) can be obtained. If cooling means such as a fan is used, it is even possible to achieve bulb wall loading of about 300 $W/cm^2$ or more. Rated lamp wattage is 150 W as one example (bulb wall loading in this case is about 130 $W/cm^2$), though this is not a limit for the present invention.

The first glass part 8 in the sealing part 2 contains no less than 99 percent by weight $SiO_2$. For instance, the first glass part 8 is formed using quartz glass. Meanwhile, the second glass part 7 in the sealing part 2 contains silica ($SiO_2$), and at least one of no more than 15 percent by weight $Al_2O_3$ and no more than 4 percent by weight B. For instance, the second glass part 7 is formed using Vycor glass (registered trademark No. 1657152 in Japan) manufactured by Corning Incorporated. Adding $Al_2O_3$ or B to $SiO_2$ lowers a softening point of the glass. Therefore the second glass part 7 has a lower softening point than the first glass part 8.

Vycor glass mentioned here is formed by mixing an additive into quartz glass to lower a softening point, thereby achieving higher workability than that of quartz glass. Vycor glass can be created, for example, by conducting a thermochemical treatment on borosilicate glass so as to approach the properties of quartz. As one example, Vycor glass contains 96.5 percent by weight silica ($SiO_2$), 0.5 percent by weight alumina ($Al_2O_3$), and 3 percent by weight boron (B). The second glass part 7 contains more impurities than the first glass part 8.

(2) Principle Behind Improvements in Pressure Resistance Strength

In the sealing part 2 of this lamp 1100, the metal foil sheet 4 which is a feeder is sealed in the first glass part 8 with the second glass part 7 being interposed between the first glass part 8 and a portion of the metal foil sheet 4 on the discharge space 9 side. In this way, the pressure resistance strength in the sealing part 2 can be significantly increased (40 MPa to 50 MPa). This can be attributed to that a compressive strain occurring in the sealing part 2 and especially a compressive stress occurring in the sealing part 2 in its longitudinal direction. This principle is explained in more detail below.

Figure 4A:
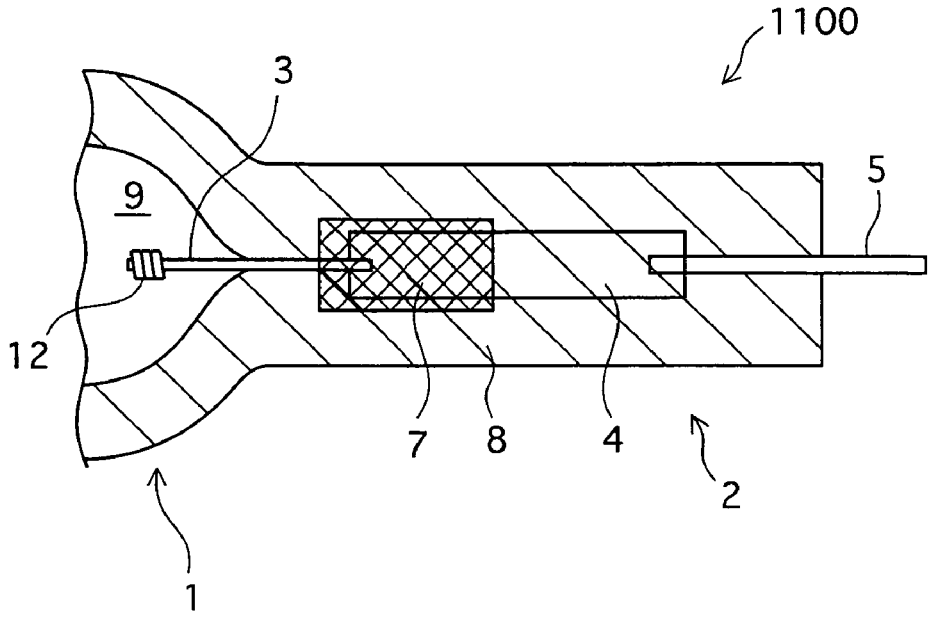
FIGS. 4A and 4B are each an essential part enlargement for conceptually showing a distribution of compressive strains along a sealing part 2 (in an electrode axial direction).
Figure 4B:
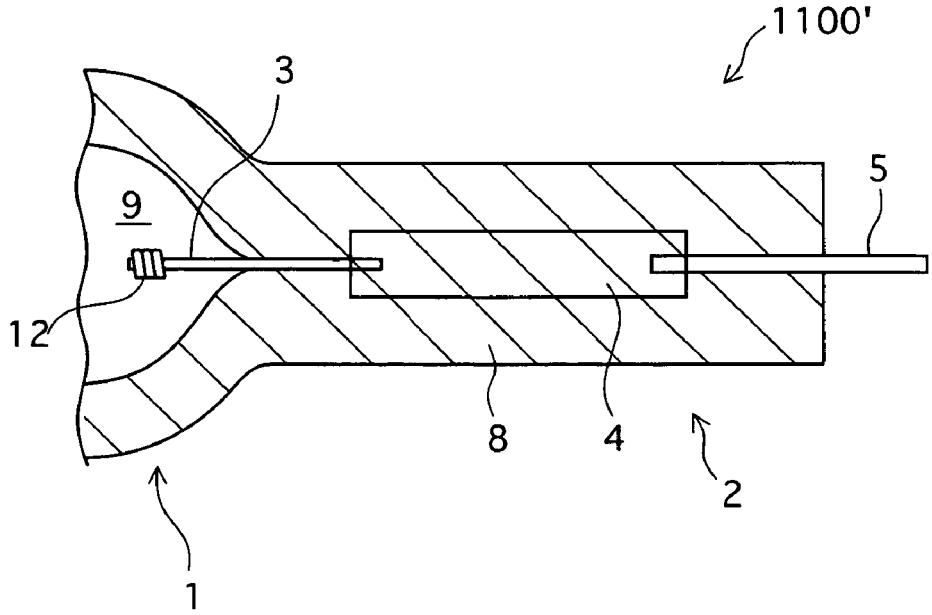

FIGS. 4A and 4B each schematically show a distribution of compressive strains in the longitudinal direction of the sealing part 2 (electrode axial direction). FIG. 4A corresponds to the lamp 1100 with the second glass part 7, whereas FIG. 4B corresponds to a conventional lamp 1100' without the second glass part 7 (comparative sample).

In the sealing part 2 shown in FIG. 4A, a compressive stress (compressive strain) is present in an area corresponding to the second glass part 2 (double hatched area), whilst substantially no compressive stress is present in an area corresponding to the first glass part 8 (diagonally shaded area). In the sealing part 2 without the second glass part 7 shown in FIG. 4B, on the other hand, there is no specific area where a compressive strain is present, with the first glass part 8 having substantially no compressive stress.

As a result of quantitatively measuring the strain of the lamp 1100, a compressive stress was observed in the second glass part 7 in the sealing part 2. This strain quantification was conducted with a sensitive tint plate using photoelasticity. According to this method, a portion where a strain (stress) exists appears to have a different color. This color is compared with a strain standard, with it being possible to quantify the amount of strain. Which is to say, by reading an optical path difference of a color that is the same as a color of a strain to be measured, a stress can be calculated. A strain tester (SVP-200 manufactured by Toshiba Corporation) was used as a measuring instrument for strain quantification. This strain tester calculates an amount of compressive strain of the sealing part 2 as a mean value of stresses applied to the sealing part 2.

Figure 5A:
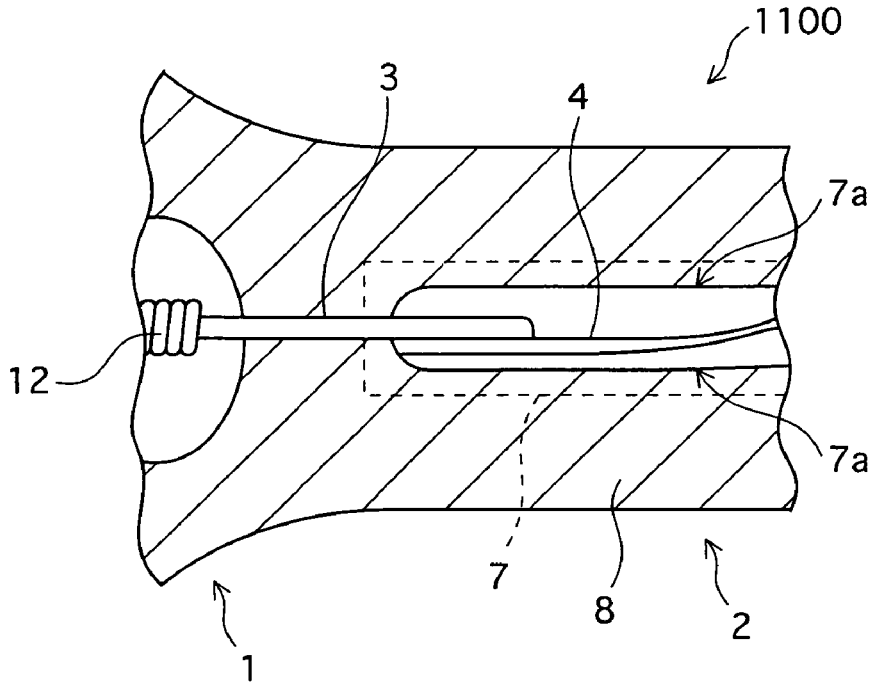
FIGS. 5A and 5B are each a representation of a distribution of compressive stresses measured using a sensitive tint plate.
Figure 5B:
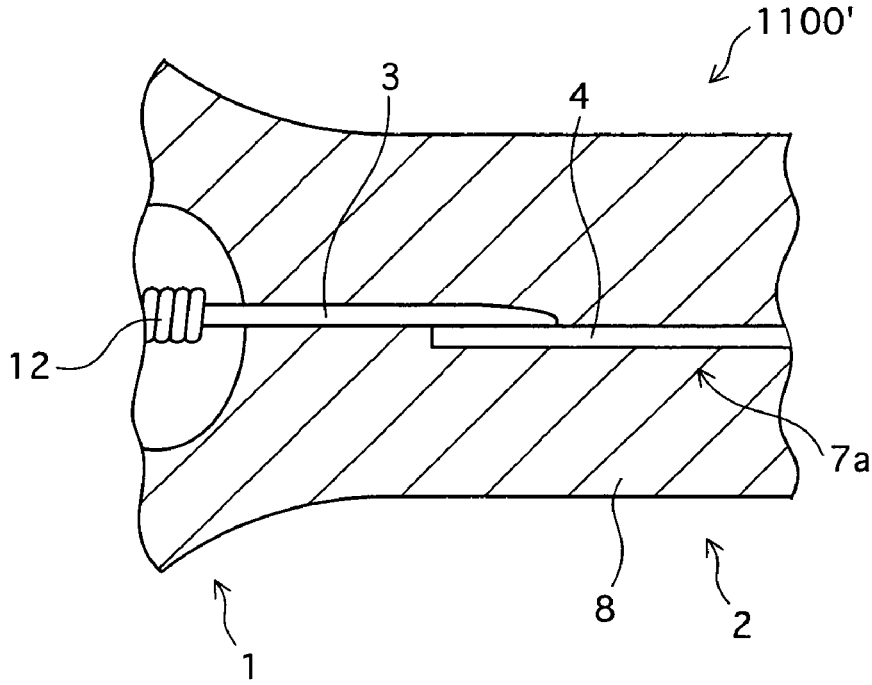

FIG. 5A schematically shows a distribution of compressive stresses in the lamp 1100, measured with a sensitive tint plate using photoelasticity. FIG. 5B schematically shows a distribution of compressive stresses in the lamp 1100' without the second glass part 7.

In FIG. 5A, an area 7*a* (white-colored area in the drawing) within the second glass part 7 in the sealing part 2 of the lamp 1100 is different in color from the first glass part 8. This indicates that a compressive stress (compressive strain) exists in the second glass part 7.

In FIG. 5B, on the other hand, there is no portion which differs in color from the other portions in the sealing part 2 of the lamp 1100'. This indicates that no compressive stress exists in any specific portion of the sealing part 2 (the first glass part 8).

The occurrence of such a compressive stress can be attributed to differences in softening point and strain point between quartz glass and Vycor glass. After sealing is performed by heating the side tube part to soften the first glass part 8 and the second glass part 7, the first glass part 8 becomes hardened first because it has a higher softening point than the second glass part 7, and then the second glass part 7 becomes hardened within a restricted space inside the already hardened first glass part 8. As a result, a compressive stress appears in the second glass part 7. This is explained in detail in Japanese Patent Application Publication No. 2003-234067 and so its further explanation has been omitted here.

In the sensitive tint plate measurement result shown in FIG. 5A, a compressive stress was observed only in the longitudinal direction of the metal foil sheet 4. Based on the above consideration about the cause of compressive stresses, however, it can be assumed that a compressive stress also exists in a perpendicular direction, along the diameter of the second glass part 7.

Note here that quartz glass which constitutes the first glass part 8 has a softening point of about 1650° C. and Vycor glass which constitutes the second glass part 7 has a softening point of about 1530° C., such that they have a difference of at least 100° C. in softening point.

Thus, since a portion having a compressive stress especially in an axial direction of the electrode rod 3 is present around the metal foil sheet 4 in the sealing part 2, the lamp 1100 exhibits a higher pressure resistance strength. Such a lamp 1100 can be lit even with an inner pressure of 50 MPa at the maximum, with it being possible to achieve a higher output.

Though the direct cause-and-effect relationship between the existence of a compressive stress in the sealing part and the improvement in pressure resistance strength has not been completely explained, it can be assumed that the compressive stress in the longitudinal direction of the second glass part 7 serves to suppress the occurrence of stress from the metal foil sheet 4.

In other words, the occurrence of stress from the metal foil sheet 4 is suppressed by the compressive stress of the second glass part 7. As a result, the glass that forms the sealing part 2 is kept from cracking, and the occurrence of leakage between the sealing part 2 and the metal foil sheet 4 is prevented. This contributes to a greater strength of the sealing part 2.

(3) Lamp Manufacturing Method

The following describes the manufacturing method of the lamp 1100 to which this embodiment relates.

This manufacturing method is roughly made up of a lamp formation step and an electric field application step of applying an electric field to a formed lamp to remove impurities inside the light emitting part 1.

The manufacturing method of the lamp 1100 is described in detail below, with reference to FIGS. 6 to 12.

(3-1) Lamp Formation Step

Figure 6:
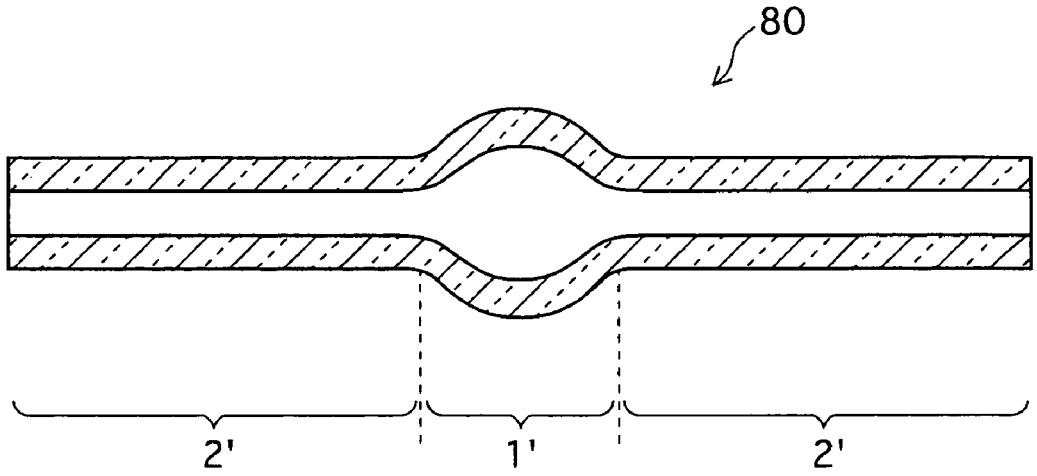
FIG. 6 is a sectional view of a construction of a glass pipe 80 for a discharge lamp.

First, a glass pipe 80 for a discharge lamp is prepared as shown in FIG. 6. The glass pipe 80 has a scheduled light emitting part 1' which is to be formed into the light emitting part 1 of the lamp 1100, and side tube parts 2' extending from the scheduled light emitting part 1'.

In this embodiment, the glass pipe 80 is produced by expanding a middle portion of a quartz glass tube, which is 6 mm in outside diameter and 2 mm in inside diameter, by application of heat so as to form the scheduled light emitting part 1' having a substantially spherical shape.

Figure 7:
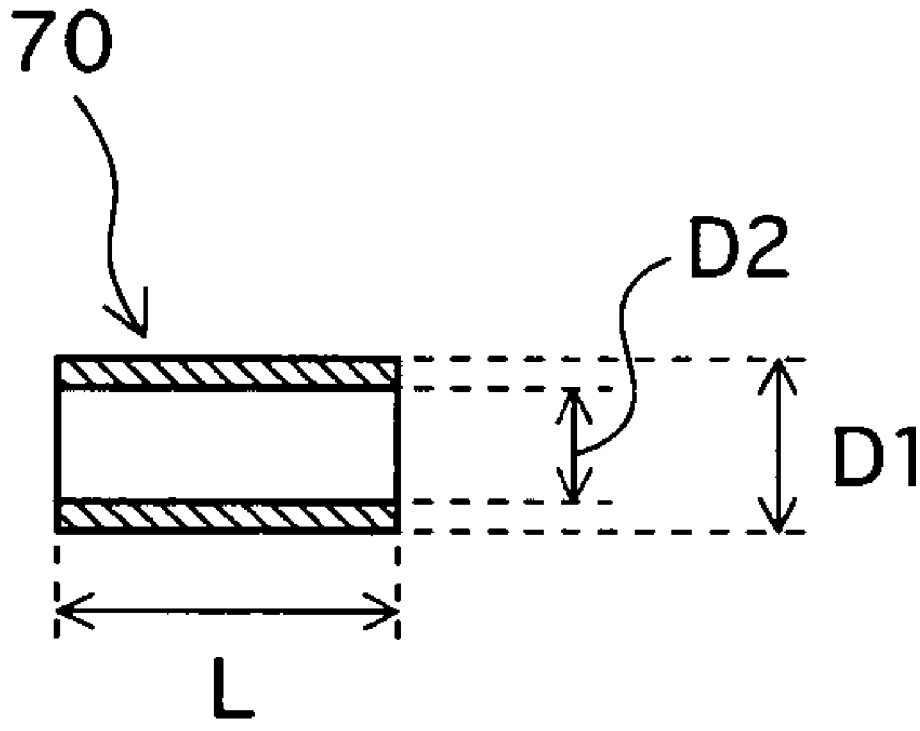
FIG. 7 is a sectional view of a construction of a glass tube 70.

In addition to the glass pipe 80, a glass tube 70 which is to be formed into the second glass part 7 is prepared as shown in FIG. 7. In this embodiment, the glass tube 70 is a Vycor glass tube which is 1.9 mm in outside diameter (D1), 1.7 mm in inside diameter (D2), and 7 mm in length (L). The outside diameter D1 of the glass tube 70 is set to be smaller than the inside diameter of the side tube parts 2' of the glass pipe 80 so that the glass tube 70 can be inserted in the side tube parts 2'.

Figure 8:
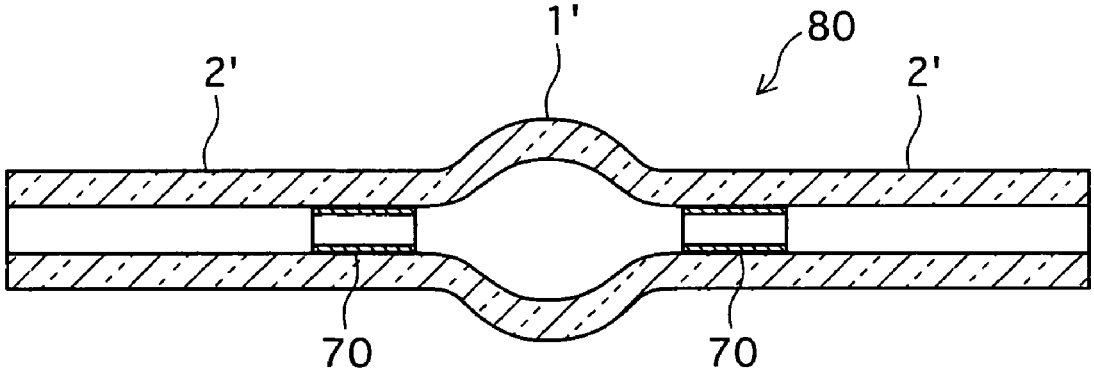
FIG. 8 is a sectional view for explaining a step of fixing the glass tube 70 in each side tube part 2' of the glass pipe 80.

Next, the glass tube 70 is fixed inside each of the side tube parts 2' of the glass pipe 80 at a predetermined position, as shown in FIG. 8. This can be done by inserting the glass tube 70 into the side tube part 2' and then heating the side tube part 2' using a burner or the like to put the side tube part 2' and the glass tube 70 in tight contact with each other.

Figure 9:
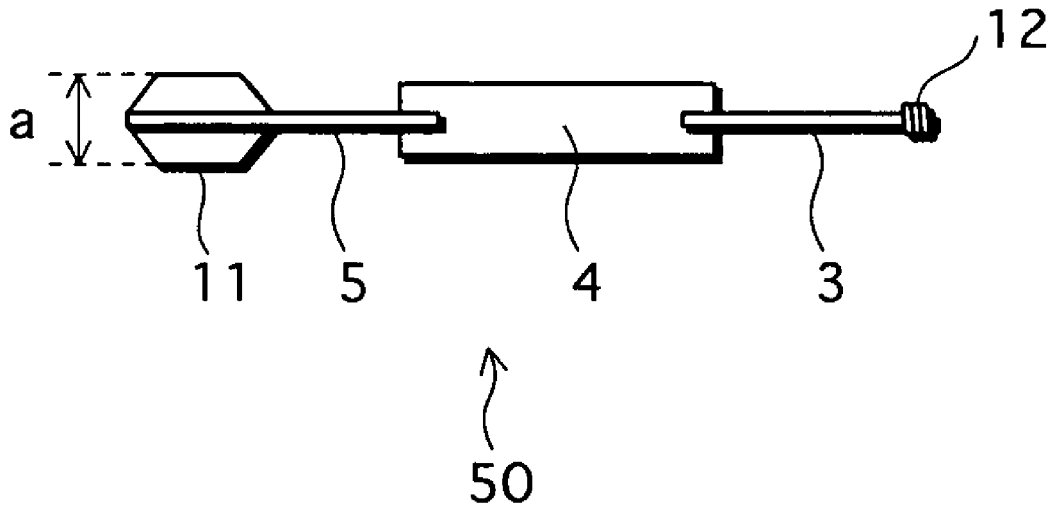
FIG. 9 is a representation of a construction of an electrode structure 50.

Following this, a separately produced electrode structure 50 shown in FIG. 9 is inserted into the side tube part 2' in which the glass tube 70 is fixed. The electrode structure 50 is composed of an electrode rod 3, a metal foil sheet 4 connected to the electrode rod 3, and an external lead 5 connected to the metal foil sheet 4. The electrode rod 3 is made of tungsten. A tungsten coil 12 is wound around a tip of the electrode rod 3. Here, a thoriated tungsten coil may be used instead of the tungsten coil. Also, a thoriated tungsten electrode rod may be used instead of the tungsten electrode rod.

A support member (a metal fastening) 11 for fastening the electrode structure 50 to an inner wall of the side tube part 2' is provided at one end of the external lead 5. As one example, this support member 11 is molybdenum tape (Mo tape). Alternatively, the support member 11 may be a ring-shaped molybdenum spring. A width of the support member 11 is set to be slightly larger than the inside diameter 2 mm of the side tube part 2', to thereby secure the electrode structure 50 within the side tube part 2'.

Figure 10:
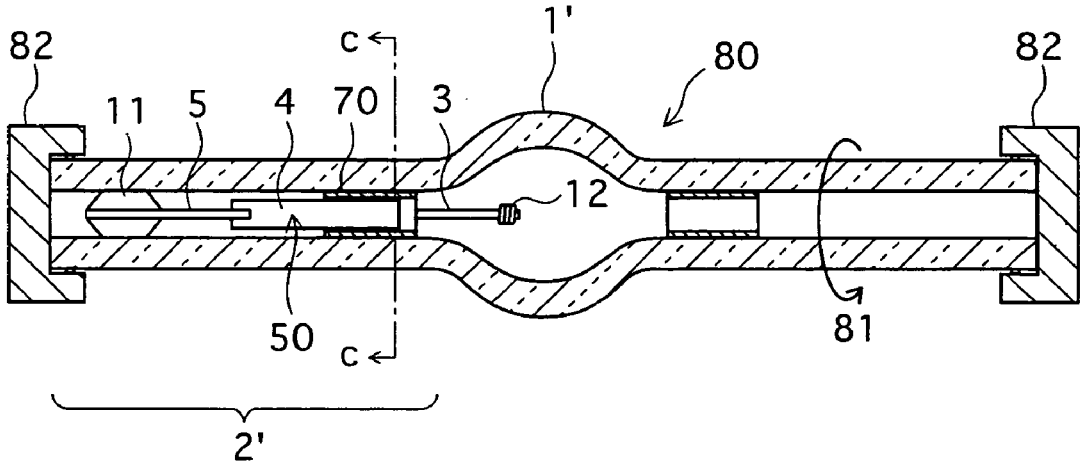
FIG. 10 is a sectional view for explaining a step of inserting the electrode structure 50.

The electrode structure 50 is then inserted into the side tube part 2' until the coil 12 end of the electrode rod 3 is located inside the scheduled light emitting part 1', as shown in FIG. 10.

Figure 11:
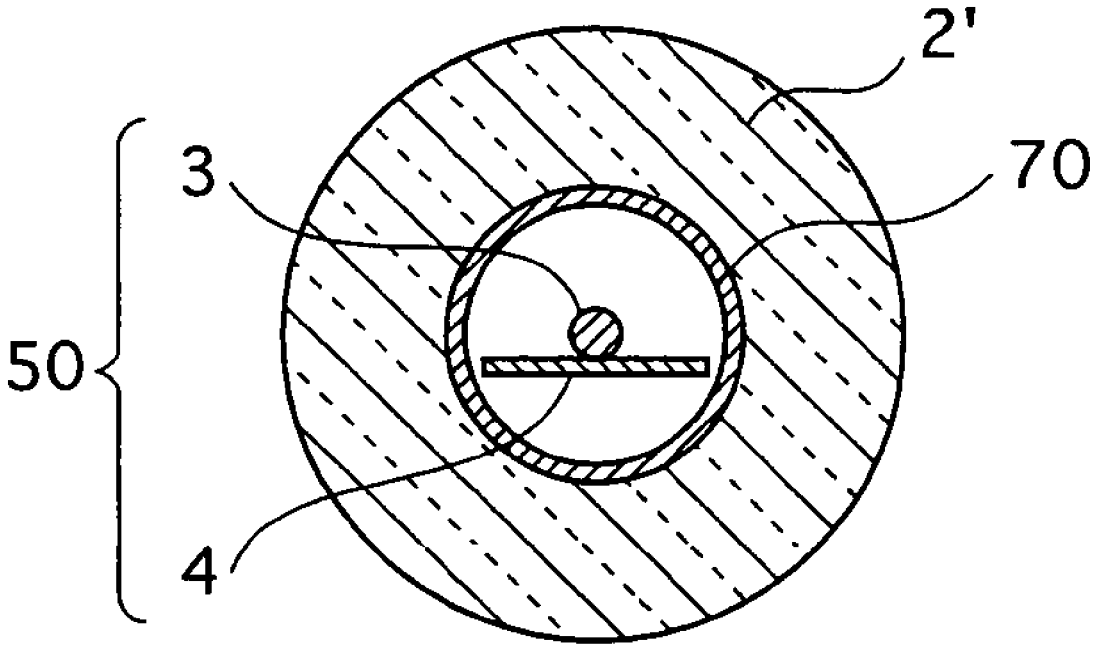
FIG. 11 is a cross sectional view taken along line c-c given in FIG. 10.
Figure 12:
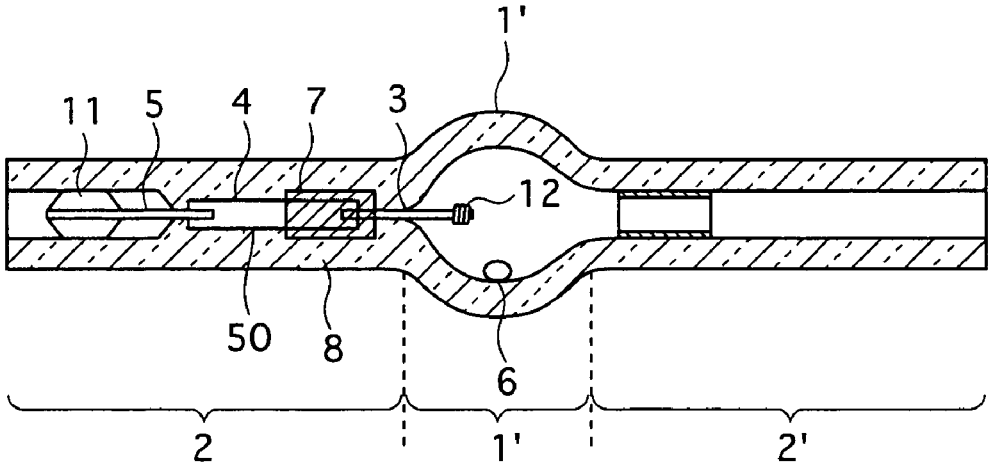
FIG. 12 is a sectional view for explaining a sealing part formation step.

FIG. 11 is a sectional view taken along line c-c in FIG. 10.

After the electrode structure 50 has been inserted, both ends of the glass pipe 80 are attached to a rotatable chuck 82 while maintaining airtightness.

The chuck 82 is connected to a vacuum system (not illustrated), with which a pressure inside the glass pipe 80 can be reduced. As described later, after evacuating the inside of the glass pipe 80, a rare gas (Ar) is introduced into the glass pipe 80 at about 200 torr (about 20 kPa).

The glass pipe 80 is then rotated around the electrode rod 3, in a direction indicated by arrow 81.

The side tube part 2' and the glass tube 70 are heated to shrink, to thereby seal the electrode structure 50. This produces the sealing part 2 in which the second glass part 7 formed from the glass tube 70 is provided inside the first glass part 8 formed from the side tube part 2'.

In more detail, the side tube part 2' and the glass tube 70 are heated to shrink gradually from a boundary between the scheduled light emitting part 1' and the side tube part 2' to near a middle portion of the external lead 5. As a result of this sealing part formation step, the sealing part 2 including a portion which has a compressive stress at least in its longitudinal direction (the axial direction of the electrode rod 3) is obtained from the side tube part 2' and the glass tube 70. Note here that the above heating and shrinkage may be performed in a direction from the external lead 5 toward the scheduled light emitting part 1'.

After this, a predetermined amount of mercury 6 is introduced from an end of the other side tube part 2' which has not been sealed yet. When doing so, a halogen (e.g. $CH_2Br_2$) is introduced as well, according to need.

After the introduction of the mercury 6, the same step is conducted on the other side tube part 2' which has not been sealed yet. In detail, the electrode structure 50 is inserted into the side tube part 2', and then the inside of the glass pipe 80 is vacuumed (preferably depressurized to about $10^{-4}$ Pa) to enclose the rare gas. After this, the side tube part 2' is sealed by application of heat. This sealing is preferably performed while cooling the scheduled light emitting part 1', to prevent the mercury from evaporation. After sealing both of the side tube parts 2' in this way, unnecessary portions of the side tube parts 2' are cut off to complete the construction of the lamp 1100 shown in FIG. 3.

(3-2) Electric Field Application Step

The electric field application step is intended to remove impurities inside the light emitting part 1 by applying an electric field to at least the light emitting part 1 of the lamp 1100. In this embodiment, the electric field application step is performed at the time of initial lighting (aging) after the formation of the lamp 1100.

Figure 13:
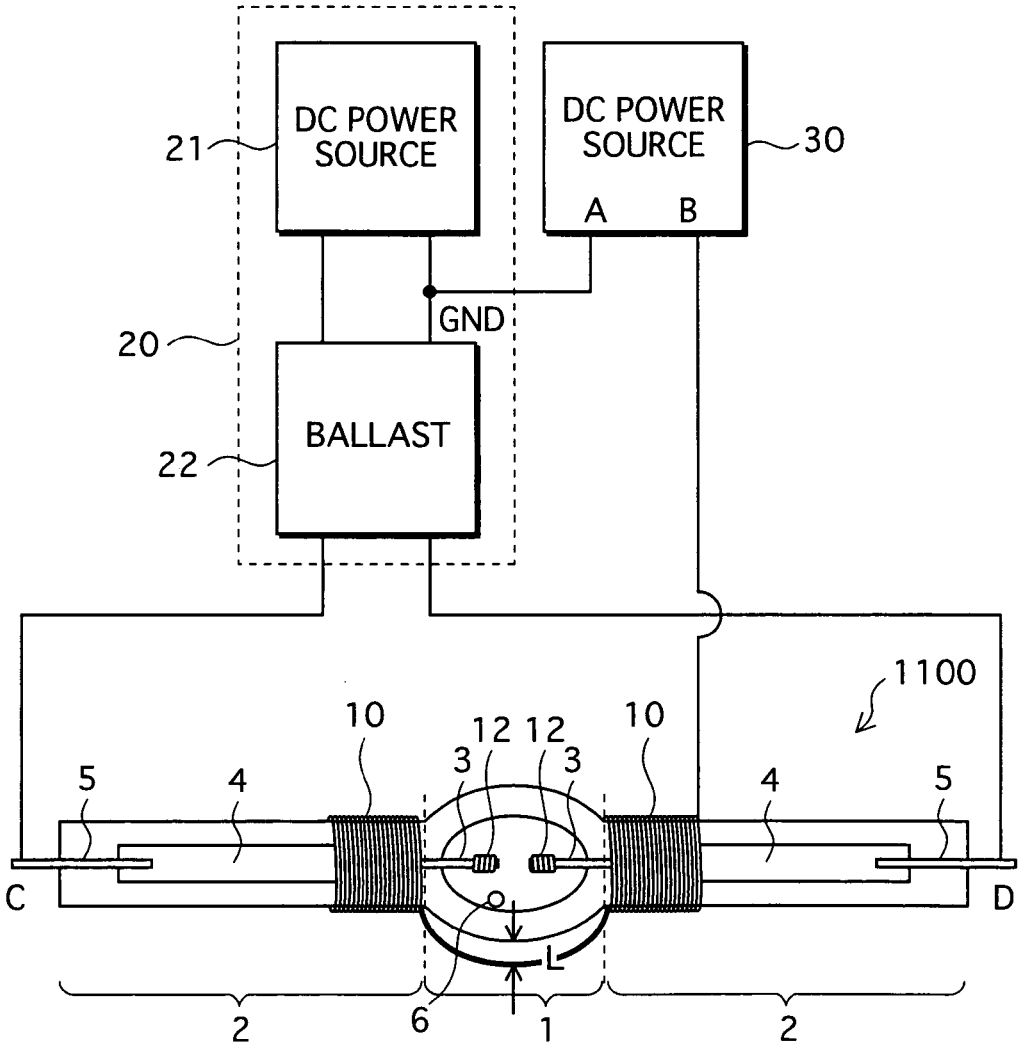
FIG. 13 is a diagram for explaining an electric field application step of the first embodiment.

FIG. 13 schematically shows a device for performing the electric field application step.

Reference numeral 20 denotes a lighting device for the lamp 1100, which includes a DC power source 21 and a ballast 22. An alternating voltage output from the ballast 22 is fed to ends C and D of the pair of external leads 5 of the lamp 1100.

Figure 14:
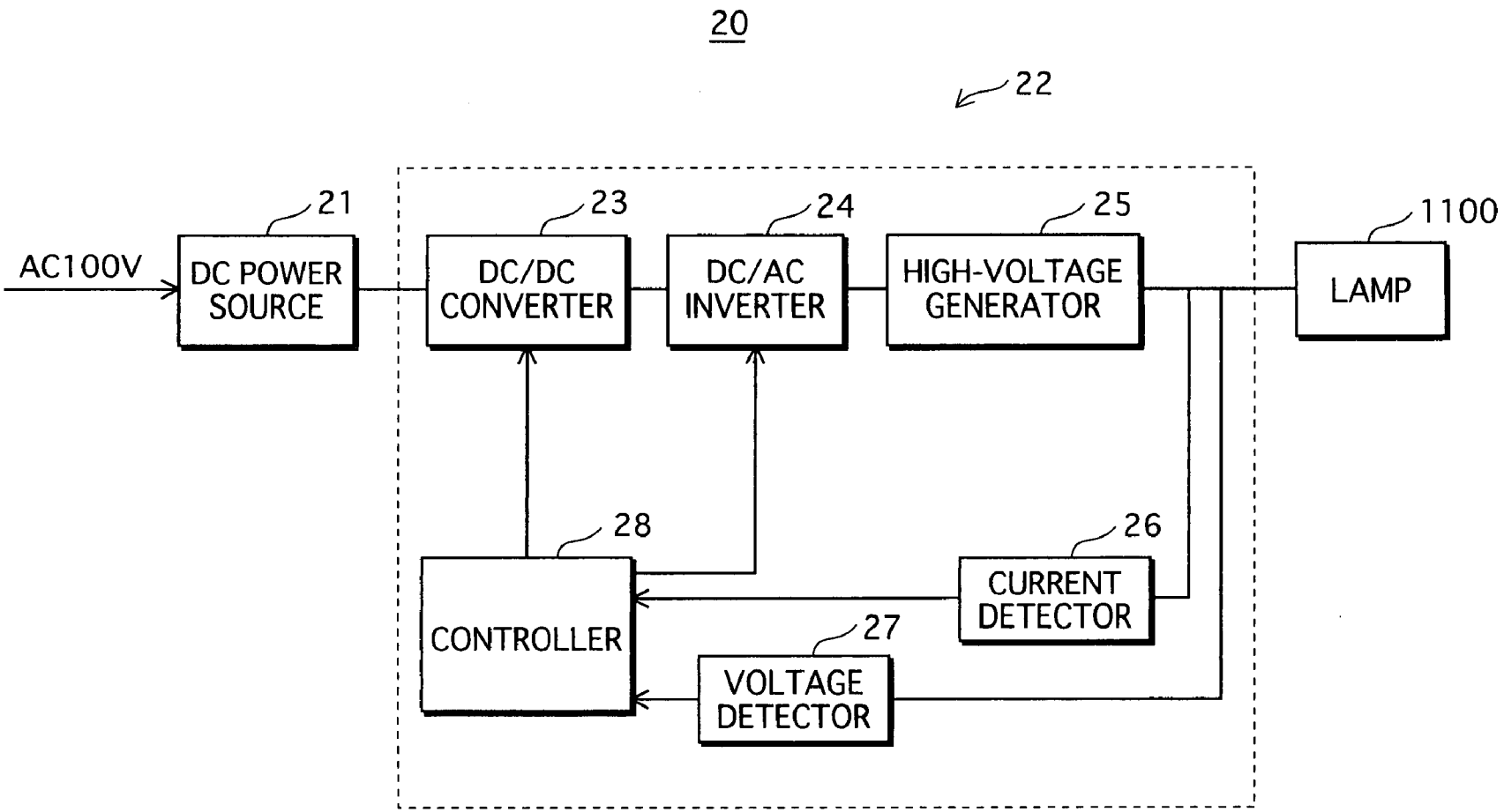
FIG. 14 is a block diagram of a construction of a lighting device 20 shown in FIG. 13.

FIG. 14 is a block diagram of a construction of the lighting device 20 and especially the ballast 22 in detail. The DC power source 21 is connected to an AC power source (AC 100V) (not illustrated), and supplies a predetermined direct voltage to the ballast 22. The ballast 22 includes a DC/DC converter 23 for supplying power required for lighting the lamp 1100, a DC/AC inverter 24 for converting the output of the DC/DC converter 23 to an alternating current of a predetermined frequency, a high-voltage generator 25 for applying a high-voltage pulse to the lamp 1100 at start-up, a current detector 26 for detecting a lamp current of the lamp 1100, a voltage detector 27 for detecting a lamp voltage of the lamp 1100, and a controller 28 for controlling the outputs of the DC/DC converter 23 and the DC/AC inverter 24.

The controller 28 receives detection signals from the current detector 26 and the voltage detector 27, and controls the DC/DC converter 23 and the DC/AC inverter 24 so as to keep the power supplied to the lamp 1100 at a predetermined level.

Referring back to FIG. 13, the device for performing the electric field application step includes a DC power source 30 in addition to the DC power source 21 in the lighting device 20. Output A of the DC power source 30 is connected to a ground output (GND) of the DC power source 21. Meanwhile, a predetermined negative voltage is output from output B of the DC power source 30.

A conductive wire 10 is wound around the pair of sealing parts 2 of the lamp 1100, for a predetermined width from the boundary between the light emitting part 1 and each sealing part 2. In detail, the conductive wire 10 is wound around one sealing part 2, and then wound around the other sealing part 2 across the light emitting part 1; the number of turns is about ten on each of the left and right sides. A minimum distance L between the conductive wire 10 that crosses over the light emitting part 1 and a surface of the light emitting part 1 is about 2 mm. In this embodiment, the outside diameter of the light emitting part 1 is about 10 mm. Accordingly, a distance between the electrode rod 3 and the conductive wire 10 that crosses over the light emitting part 1 is about 7 mm.

The conductive wire 10 wound around the lamp 1100 is connected to output B of the DC power source 30. In a state of applying −300 V to the conductive wire 10, the lighting circuit 20 is turned on to light the lamp 1100 for several hours.

In this embodiment, the lamp 1100 is lit by alternating current of a rectangular waveform. Accordingly, the electrode on the C side and the electrode on the D side are alternately grounded during lighting. A potential difference between the C and D sides is equal to the lamp voltage, namely, about 60 V to about 90 V. Whichever of the electrodes on the C and D sides is grounded, a potential difference of about 300 V appears between the electrode in the light emitting part 1 and the conductive wire 10. The same effects can be produced in the case of a direct current lamp in which one of the electrodes on the C and D sides is fixed to a ground.

As a result, a strong electric field is generated in a direction from the electrode rod 3 toward the conductive wire 10, in the light emitting part 1.

To examine the effects of this electric field application step, a lamp which has undergone initial lighting with application of an electric field was compared with a conventional lamp which has undergone initial lighting without application of an electric field.

In more detail, fifteen lamps which have the same construction as the lamp 1100 and to which an electric field has not been applied were prepared. Five of these lamps were lit according to a conventional method. The remaining ten lamps were lit while applying a voltage of −300 V from the DC power source 30 to the conductive wire 10 wound around the sealing parts 2, as shown in FIG. 13.

Figure 15A:
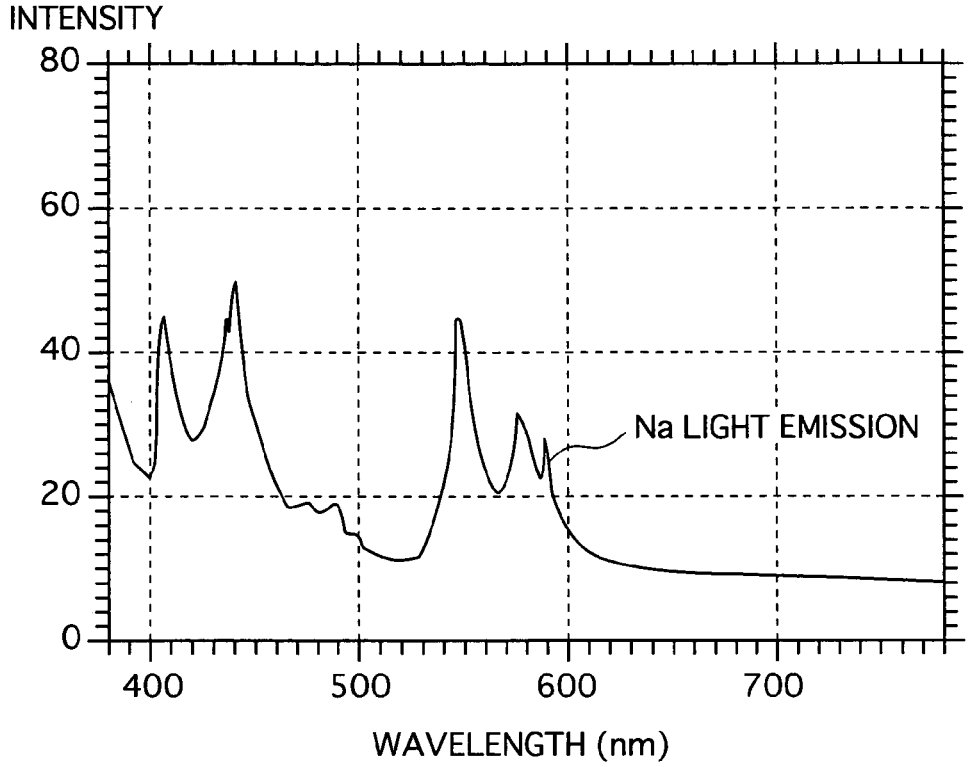
FIG. 15A shows a spectral distribution of luminous fluxes of a high pressure mercury lamp on which the electric field application step of the first embodiment was not performed.

The lamps of both groups were lit for two hours. As a result, the five lamps lit according to the conventional method were all slightly blackened. When measuring a spectral distribution of luminous fluxes of these lamps using a spectrophotometer, an Na light emission was observed as shown in FIG. 15A.

On the other hand, none of the ten lamps lit according to the present invention were blackened. Also, no Na light emission was observed in these lamps (see FIG. 15B).

For each of the conventional sample and the present invention sample on which the electric field application step was performed, a Na content in diagonally shaded area E in the light emitting part 1 and diagonally shaded area F in the sealing part 2 where the second glass part 7 is not positioned (see FIG. 16A) was analyzed using an atomic absorption analysis method. The result of this analysis is shown in table 1 in FIG. 16B.

As is clear from table 1, the Na content in the light emitting part 1 was 0.61 ppm in the conventional sample. In the present invention sample, on the other hand, the Na content in the light emitting part 1 was reduced to 0.11 ppm which is almost one sixth of that of the conventional sample.

This demonstrates that the impurities which have entered in the light emitting part 1 are reduced and as a result blackening is prevented by the electric field application step of this embodiment. Devitrification is prevented as a result of the reduction in impurities, too. This contributes to a longer lamp life.

The following examines a mechanism for suppressing blackening and devitrification.

During stable lighting of a lamp, an arc discharge occurs between the electrode rods 3, a temperature of which reaches 6000° C. or more at the maximum. This causes a temperature in the light emitting part 1 to increase to 1000° C. or more. In such a high temperature condition, impurities which are present in the discharge space 9 and in the glass that forms the light emitting part 1 tend to ionize.

When an electric field is applied to this state of lamp from outside, an electrostatic force acts so as to move the ions. In this embodiment, the inside of the light emitting part 1 is set to a ground while the outside of the light emitting part 1 is set to −300 V. Accordingly, positive ions are forced to move toward the outside of the light emitting part 1. As a result, the positive ions are diffused into the quartz glass, and eventually emitted outside of the light emitting part 1.

Especially, positive ions of hydrogen, an alkali metal (potassium, lithium, or sodium), and the like tend to cause blackening and devitrification. As a result of the electric field application step described above, such impurities that cause blackening and devitrification can be reduced in the discharge space 9.

Figure 15B:
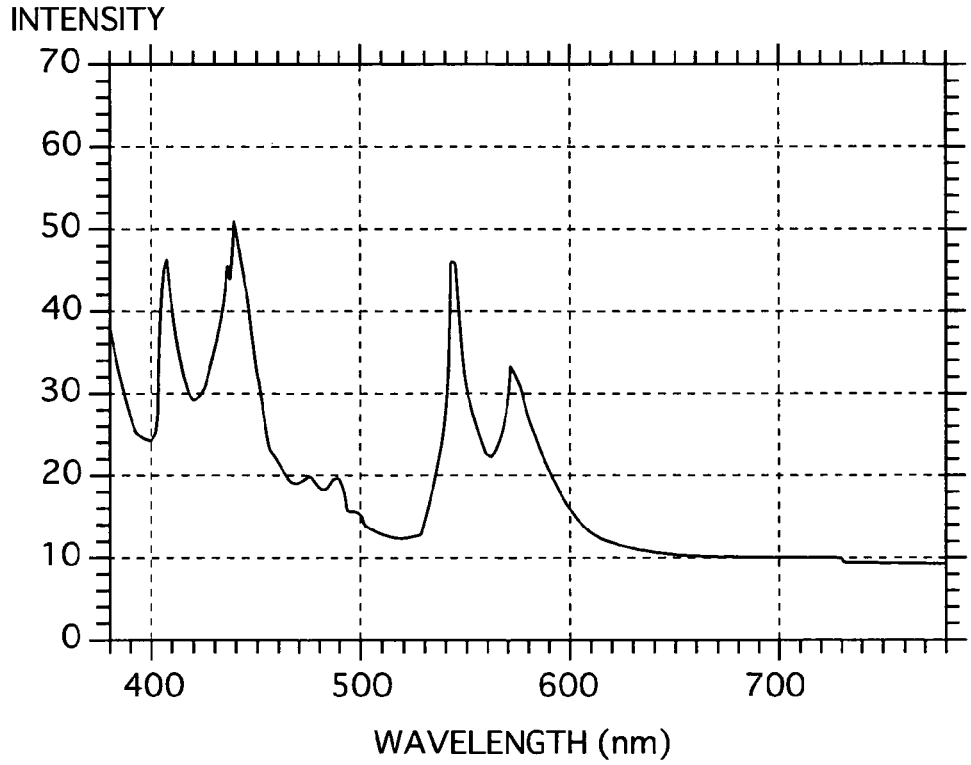
FIG. 15B shows a spectral distribution of luminous fluxes of a high pressure mercury lamp on which the electric field application step of the first embodiment was performed.
Figures 16A, 16B:
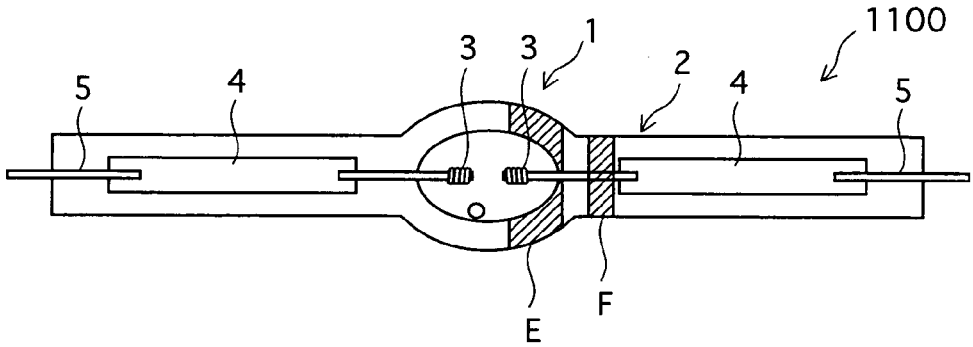
FIG. 16A shows measurement locations of a Na content in the high pressure mercury lamp on which the electric field application step of the first embodiment was performed.
FIG. 16B is a table showing a result of the measurement.

It was actually confirmed, from the spectral distribution shown in FIG. 15B and the analysis result shown in FIG. 16B, that the Na content in the discharge space 9 and in the glass of the light emitting part 1 was reduced when compared with the conventional sample.

It was also confirmed that a hydrogen ($H_2$) content in the discharge space 9 was greatly reduced as a result of the electric field application step. Conventionally, a process of vacuum baking an entire lamp for a predetermined time period needs to be performed at an appropriate stage after sealing, in order to reduce hydrogen in the discharge space 9 and also remove unwanted distortion of the glass which forms the light emitting part 1. With the provision of the above electric field application step, the time for such a vacuum baking process can be shortened significantly.

In this embodiment, a voltage of 300 V is applied between the conductive wire 10 outside the light emitting part 1 and the electrode rod 3 which are apart from each other by about 7 mm, so that an electric field of about 43 kV/m is generated. However, this is not a limit for the present invention. To efficiently remove impurities, the electric field strength is preferably no less than 10 kV/m. Though the electric field strength basically has no specific upper limit, increasing the electric field strength beyond the level that is necessary for removal of impurities serves no benefit. Also, a large power source is required for generating an excessively large electric field, which causes an increase in cost. Therefore, the upper limit of the electric field strength may be set at about 500 kV/m.

The lamp manufacturing method of this embodiment is particularly effective for lamps whose operating pressure reaches 23.3 MPa (230 atm, a Hg content per unit volume in the light emitting part being 230 mg/cc) or more. In a lamp with an operating pressure of 23.3 MPa or more, an arc temperature is higher and therefore a larger amount of electrode evaporates. This being so, even when only a small amount of impurities exist, a halogen cycle cannot work properly, which leads to blackening. Also, since the temperature of the light emitting part itself is higher, devitrification tends to occur at an early stage. According to the lamp manufacturing method of this embodiment, impurities such as an alkali metal (lithium, sodium, or potassium) can be greatly reduced when compared with conventional techniques. This makes it possible to ensure a life of 2000 hours or more which is conventionally unattainable for a lamp with an operating pressure of 23.3 MPa or more.

Second Embodiment

A lamp manufacturing method according to the second embodiment of the present invention is described below.

In the second embodiment, the lamp formation step is the same as that of the first embodiment. The only difference from the first embodiment lies in the electric field application step, so that the following explanation focuses on this difference.

Figure 17:
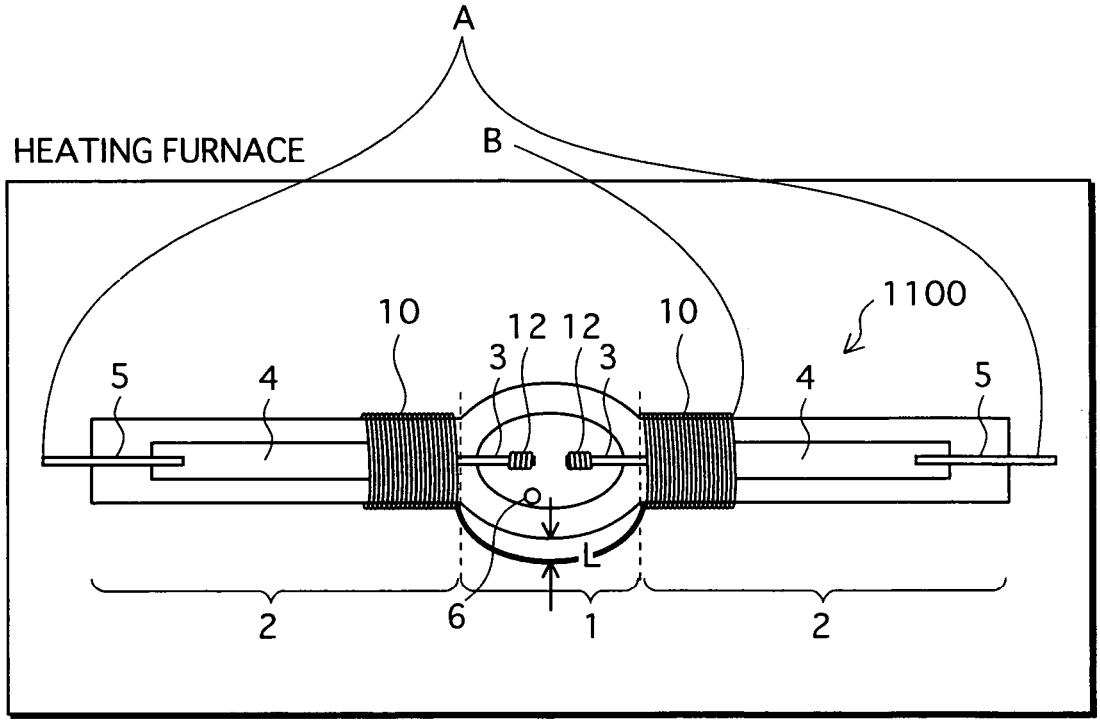
FIG. 17 is a diagram for explaining an electric field application step of the second embodiment.

FIG. 17 shows an electric field application step in the second embodiment.

After the formation of the lamp 1100, the conductive wire 10 is wound around the sealing parts 2 of the lamp 1100 in the same way as in the first embodiment, prior to initial lighting. The conductive wire 10 is wound around one sealing part, and then wound around the other sealing part across the light emitting part 1; the number of turns in each of the left and right sides is about ten. The distance L between the light emitting part 1 and the conductive wire 10 is about 2 mm. Since the outside diameter of the light emitting part 1 is about 10 mm, the distance between the electrode rod 3 and the conductive wire 10 which crosses over the light emitting part 1 is about 7 mm.

After this, the lamp 1100 is placed in an electric heating furnace. The pair of external leads 5 are connected to output A of the DC power source 30 shown in FIG. 13, and the conductive wire 10 is connected to output B of the DC power source 30. Next, −300 V is applied to the conductive wire 10 while heating the lamp 1100.

In this embodiment, the electric field application step is performed for several hours while heating the lamp 1100 at 1100° C. The heating is conducted in a state where the inside of the heating furnace is in an Ar atmosphere, so as not to oxidize the electrodes of the lamp 1100 and the conductive wire 10. As an alternative, the inside of the heating furnace may be in an $N_2$ atmosphere or a vacuum.

In this embodiment, both of the electrode rods 3 are grounded, whereas the potential of the conductive wire 10 is −300 V. Since the temperature in the lamp 1100 increases as high as 1100° C., impurities in the discharge space 9 and in the glass which forms the light emitting part 1 ionize, and positive ions of hydrogen, an alkali metal, and the like are released outside the light emitting part 1.

Thus, blackening and devitrification can be effectively suppressed.

Third Embodiment

The following describes an electric field application step according to the third embodiment of the present invention.

In the third embodiment, impurities are removed from the glass pipe which is to be formed into the light emitting part 1 and the sealing parts 2, prior to lamp formation.

Figure 18:
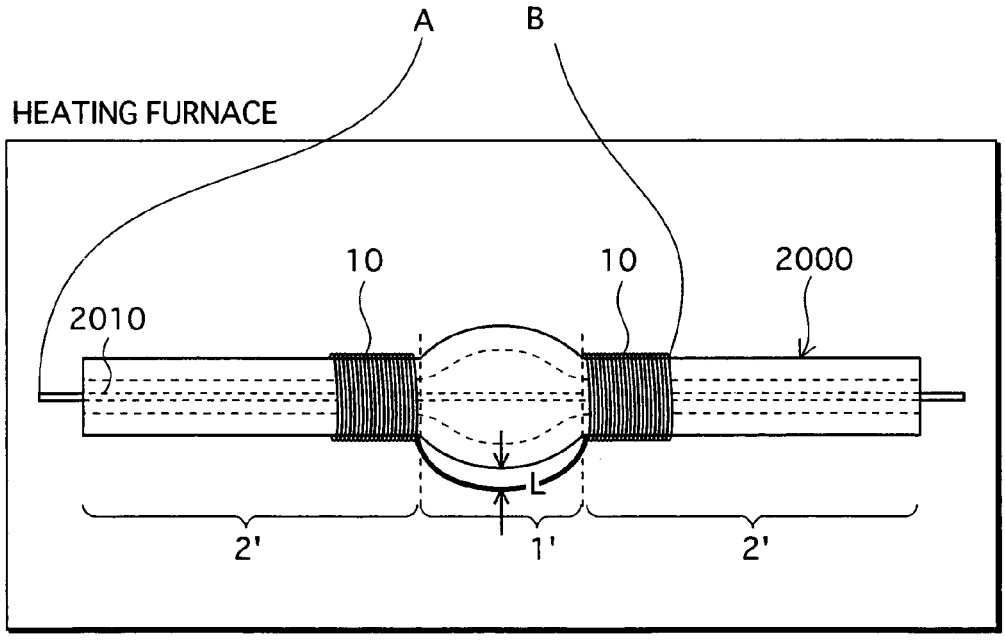
FIG. 18 is a diagram for explaining an electric field application step of the third embodiment.

FIG. 18 shows the electric field application step in the third embodiment.

In the drawing, a glass pipe 2000 is a glass pipe for a discharge lamp before manufacturing. The glass pipe 2000 is roughly made up of the scheduled light emitting part 1' which has a substantially spherical hollow shape, and the tube-shaped side tube parts 2'. A metal rod 2010 is inserted through this glass pipe 2000. The metal rod 2010 is held by a holder (not illustrated) so as to be located substantially at a tube axis of the glass pipe 2000.

The conductive wire 10 is wound around the pair of side tube parts 2' of the glass pipe 2000, in the same way as in the first and second embodiments.

The conductive wire 10 is connected to output B of the DC power source 30, whilst the metal rod 2010 is connected to output A of the DC power source 30. While the metal rod 2010 is grounded and −300 V is applied to the conductive wire 10, the glass pipe 2000 is heated in the heating furnace.

In this embodiment, the heating is performed at 1100° C. as in the second embodiment. The heating furnace is set in an Ar atmosphere so as not to oxidize the metal rod 2010 and the conductive wire 10, but the heating furnace may instead be in an $N_2$ atmosphere or a vacuum.

In this embodiment too, impurities in the glass pipe 2000 ionize, and positive ions of hydrogen, an alkali metal, and the like are released outside the glass pipe 2000.

The same heat treatment can be applied to the second glass part 7 which is to be used in the lamp 1100 shown in FIG. 3. Suppose the second glass part 7 is Vycor glass (96.5 percent by weight silica ($SiO_2$), 0.5 percent by weight alumina ($Al_2O_3$), and 3 percent by weight boron (B)). As a result of applying the heat treatment to such a second glass part 7, hydrogen and an alkali metal in the second glass part 7 can be reduced without the composition of the second glass part 7 being changed. Also, neither blackening nor devitrification was observed in a lamp manufactured using this second glass part 7.

A lamp which has undergone the electric field application step of the present invention has the following structural differences from a lamp which has not undergone the electric field application step of the present invention.

(a) An emission spectrum of impurities at the time of initial lighting is greatly reduced (see FIG. 15B).

This is because the impurities in the discharge space of the light emitting part move into the material which forms the light emitting part or outside the light emitting part as a result of the electric field application. This difference in emission spectrum is particularly remarkable when the second glass part made of Vycor glass or a functionally gradient material member is used in the sealing part.

(b) A concentration distribution of impurities appears in the light emitting part and in the sealing parts extending from the light emitting part, as a result of the electric field application (see FIG. 16). Within the light emitting part, an inner wall portion contains fewer impurities than an outer wall portion. Also, a portion where the conductive wire 10 is wound, which assumes a ring shape, contains an especially large amount of Na. These phenomena demonstrate that impurities which are ionized in the discharge space move into the light emitting part in an outward direction.

A lamp which exhibits these two properties can be judged as being produced according to the manufacturing method of the present invention.

In particular, the difference in Na content is remarkable. In this sense, a lamp according to the present invention can be defined as having a construction in which the light emitting part has a smaller Na content per unit volume than the first glass parts that extend from the light emitting part.

Note here that the Na content per unit volume of the light emitting part is preferably no more than half the Na content per unit volume of the sealing parts, according to the present invention.

(Lamp Unit and Image Display Device)

(1) Construction of a Lamp Unit

When using a lamp as a light source of an image display device, the lamp is typically combined with a concave reflecting mirror to form a lamp unit, in order to improve luminous flux collecting efficiency.

Figure 19:
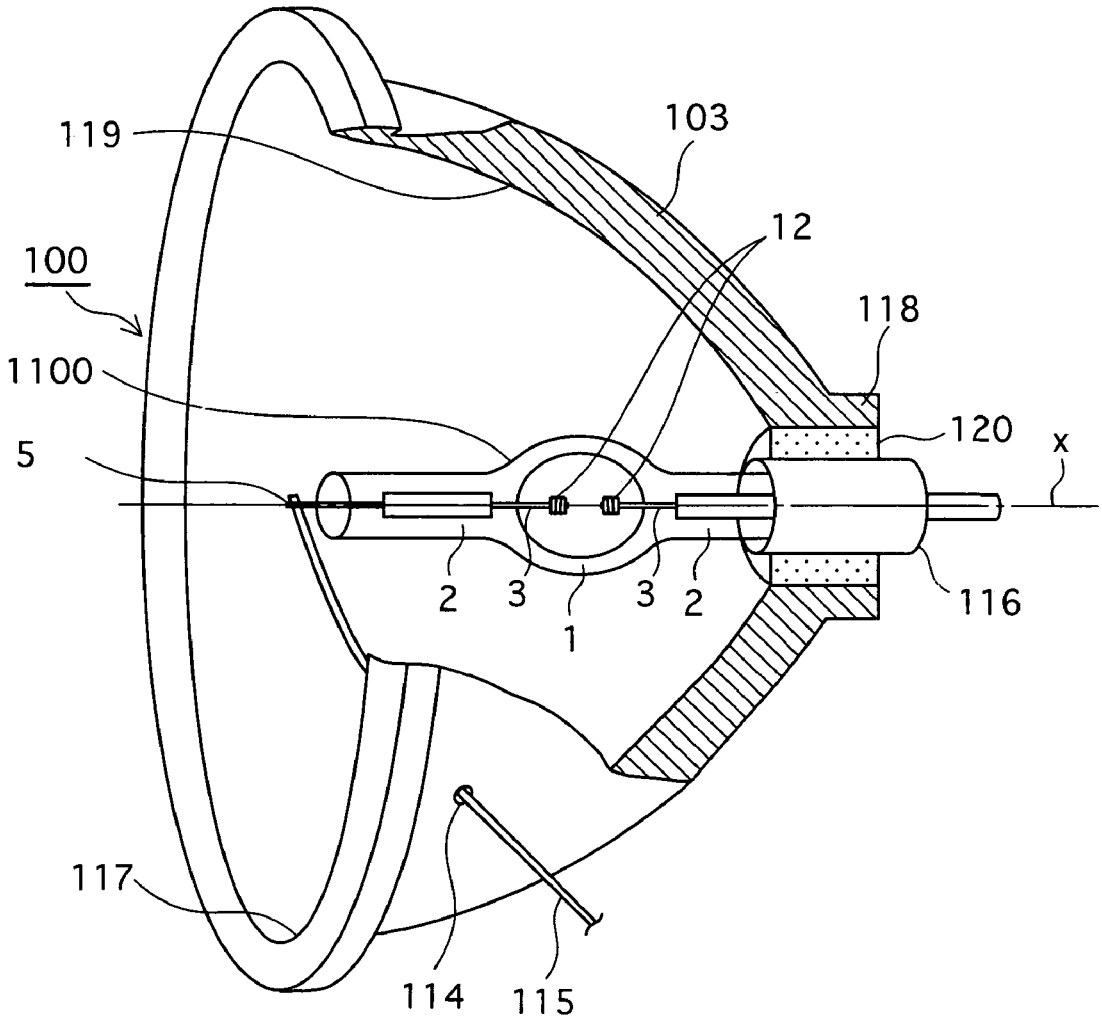
FIG. 19 is a partial cutaway view of a construction of a lamp unit in which the high pressure mercury lamp 1100 is combined with a concave reflecting mirror.

FIG. 19 is a partial cutaway perspective view showing a construction of a lamp unit 100 for a projector, in which the lamp 1100 is used as a light source.

As shown in the drawing, the lamp unit 100 has the lamp 1100 inside a concave reflecting mirror 103. The lamp 1100 is positioned such that a center of a distance between the pair of electrode rods 3 substantially coincides with a focal position of the concave reflecting mirror 103, and that central axis X of the lamp 1100 in its longitudinal direction is substantially parallel to an optical axis of the concave reflecting mirror 103 (central axis X and the optical axis coincide with each other in the example of FIG. 19).

One external lead 5 is electrically connected to a power supply line 115 which is extended outside the concave reflecting mirror 103 through a through hole 114 formed in the concave reflecting mirror 103.

The other external lead 5 (not shown in FIG. 19) is electrically connected to a base 116 that is attached to an end of one sealing part 2 of the lamp 1100 using an adhesive (not illustrated).

The concave reflecting mirror 103 has an open part 117 in front and a neck part 118 behind. An internal surface of the concave reflecting mirror 103 is shaped like a paraboloid of revolution or an ellipsoid of revolution as one example, and coated with a metal or the like by evaporation so as to form a reflecting surface 119.

The lamp 1100 and the concave reflecting mirror 103 are integrated by inserting the base 116, which is attached to the lamp 1100, into the neck part 118 and fixing them together with an adhesive 120.

Though not illustrated, a front glass is attached to the open part 117 using an adhesive or the like, to keep dust and the like from entering into the lamp unit 100.

(2) Construction of an Image Display Device

An image display device using the lamp unit 100 is described below, taking an example of a three-plate liquid crystal projector.

Figure 20:
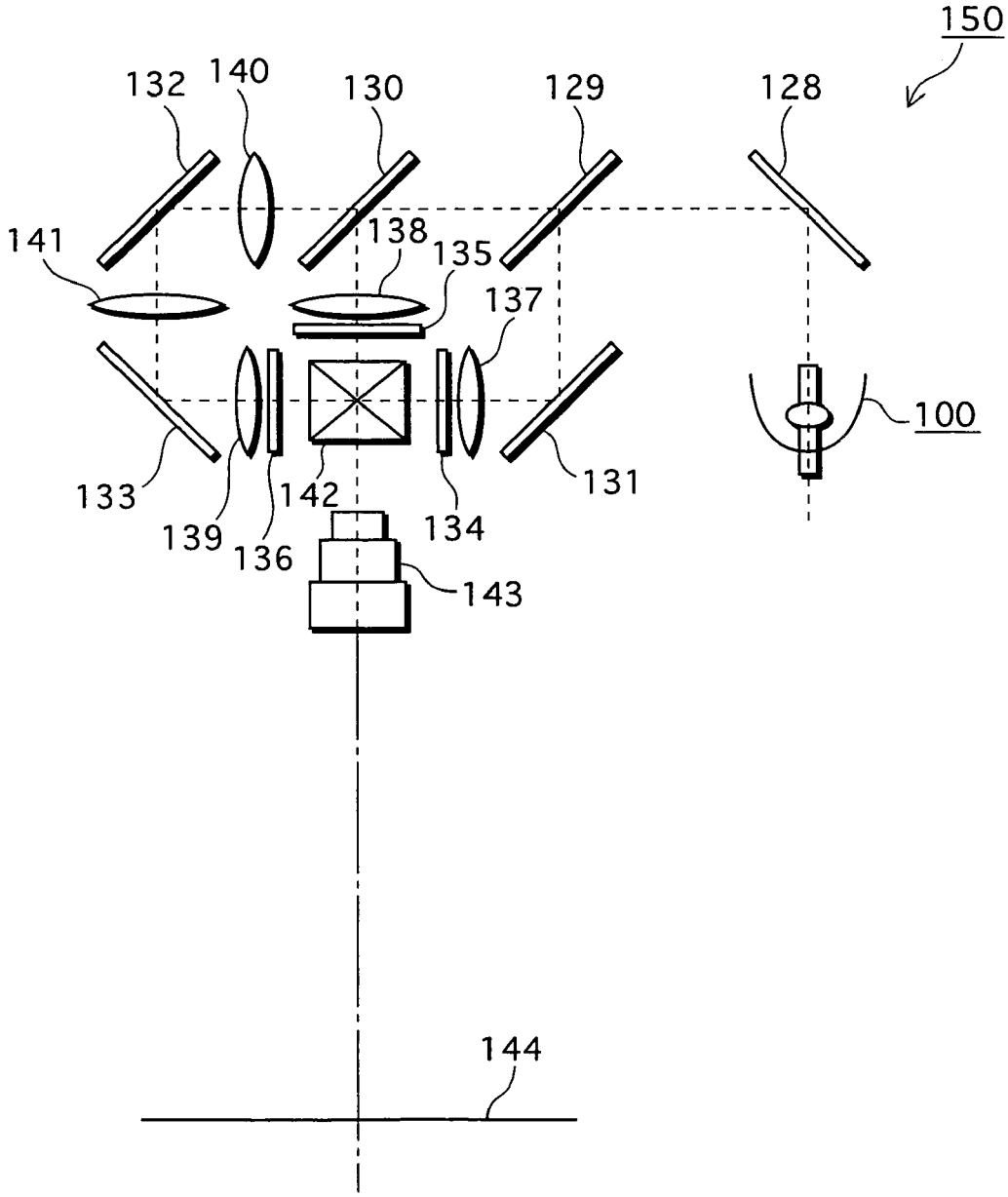
FIG. 20 shows an example construction of an image display device that uses the lamp unit shown in FIG. 19.

FIG. 20 schematically shows a construction of a three-plate liquid crystal projector 150.

In the drawing, the liquid crystal projector 150 includes the lamp unit 100 as a light source, a mirror 128, dichroic mirrors 129 and 130 for separating white light from the lamp unit 100 into three primary colors of blue, green, and red, mirrors 131, 132, and 133 each for reflecting separated light, liquid crystal light bulbs 134, 135, and 136 each for forming a monochromatic image for separated light, field lenses 137, 138, and 139, relay lenses 140 and 141, a dichroic prism 142 for combining light which has passed through the liquid crystal light bulbs 134, 135, and 136, and a projection lens 143. An image produced from this image display device is projected onto a projection plane 144 such as a screen.

The construction of this image display device is well known in the art except the lamp unit 100, optical elements such as a UV filter have been omitted here.

The lamp unit 100 uses the lamp 1100 manufactured by the aforedescribed manufacturing method, as a light source. Accordingly, the lamp unit 100 exhibits a high illuminance maintenance factor and a long life. In the image display device that uses the lamp unit 100 having a high illuminance maintenance factor, there is no need to replace the lamp unit 100 frequently. This contributes to lower maintenance cost.

Though the three-plate liquid crystal projector has been described as an example image display device, the present invention is equally applicable to a single-plate liquid crystal projector, a DLP projector, and the like.

(Modifications)

It should be obvious that the technical scope of the present invention is not limited to the above embodiments. Example modifications are given below.

(1) Modifications of the Electric Field Application Step

The method of applying a voltage is not limited to the above, so long as a potential difference is generated between the inside and outside of the light emitting part.

Figure 21A:
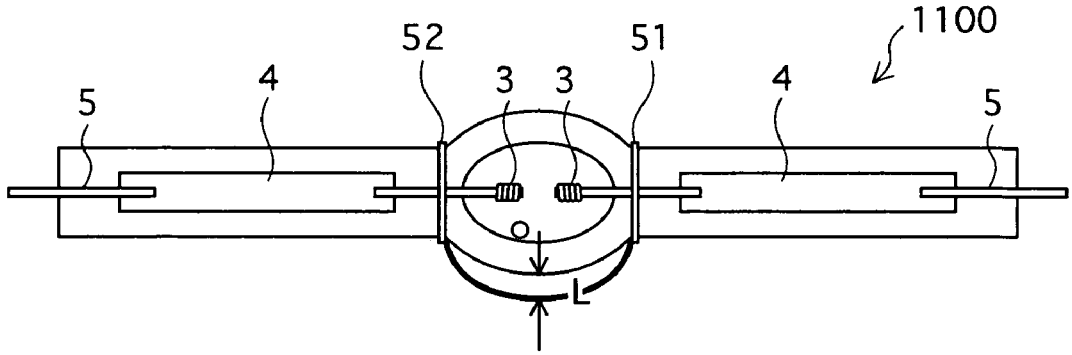
FIGS. 21A and 21B show electric field application steps according to modifications.
Figure 21B:
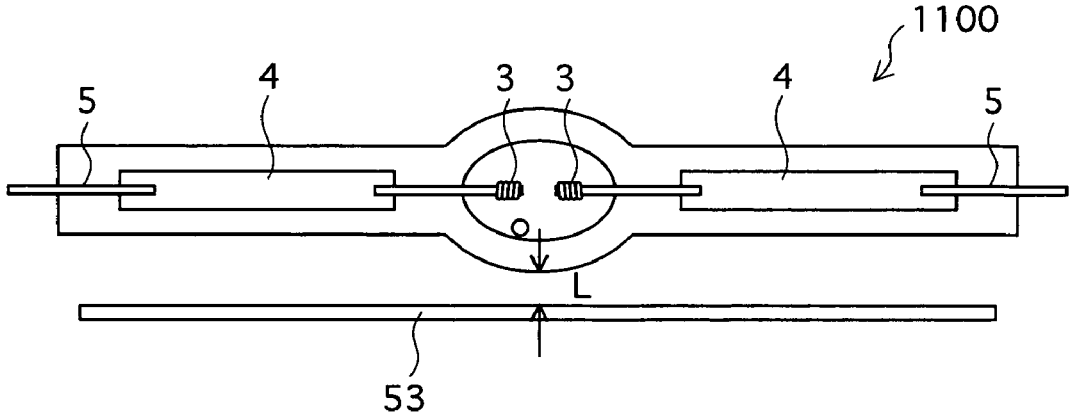
Figure 22A:
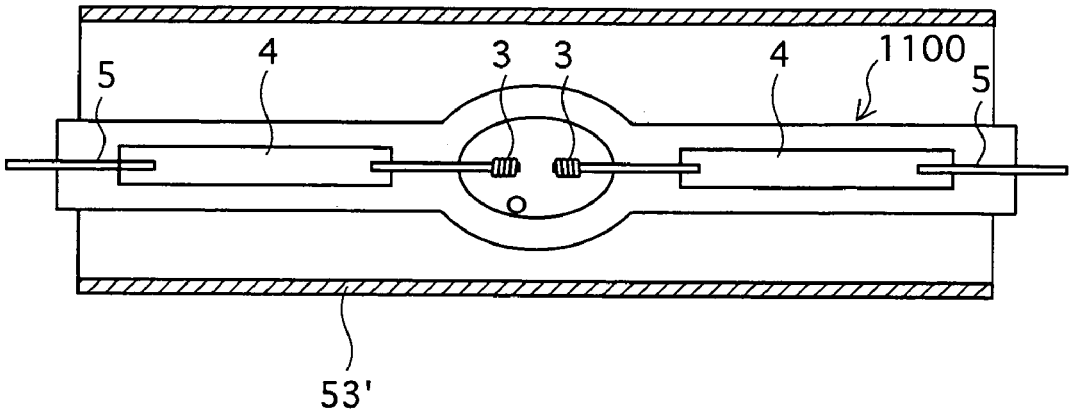
FIGS. 22A and 22B show electric field application steps according to modifications.

For instance, the first embodiment describes the case where the conductive wire 10 is wound around each of the sealing parts 2 by ten turns, but the number of turns is not limited to this. As one example, the same effects can be achieved by winding each of conductive wires 51 and 52 only by one turn as shown in FIG. 21A. Alternatively, a conductive plate or rod 53 may be provided near the light emitting part 1 as shown in FIG. 21B. Also, impurities can be released more effectively if the lamp 1100 is inserted in a tubular electrode 53' as shown in FIG. 22A.

Figure 22B:
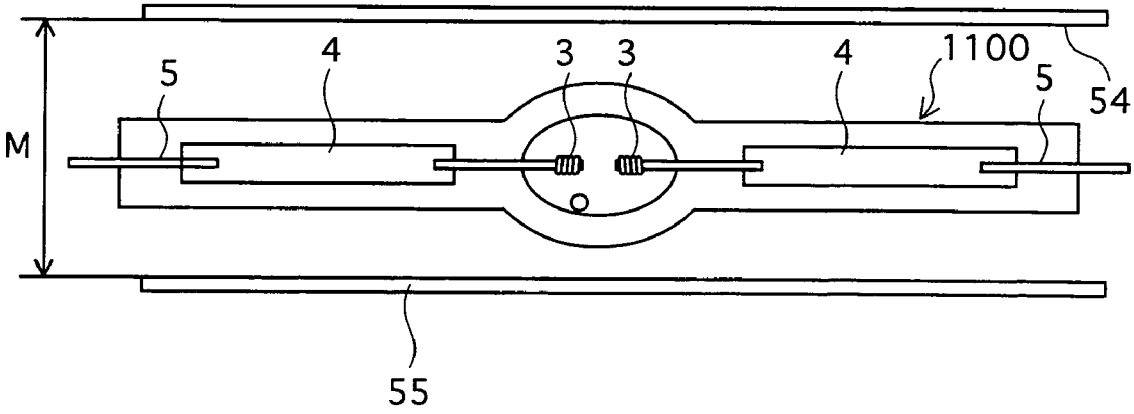

Further, two conductive plates 54 and 55 may be provided on both sides of the lamp 1100 as shown in FIG. 22B, with a potential difference being applied between these conductive plates 54 and 55. In this case, positive ions are drawn toward one conductive plate whereas negative ions are drawn toward the other conductive plate. This produces an effect of removing both positive ion impurities and negative ion impurities.

Electric field application steps performed in the case of FIGS. 21A and 22B are explained below, respectively as modifications 1 and 2.

(1-1) Modification 1

Figure 23:
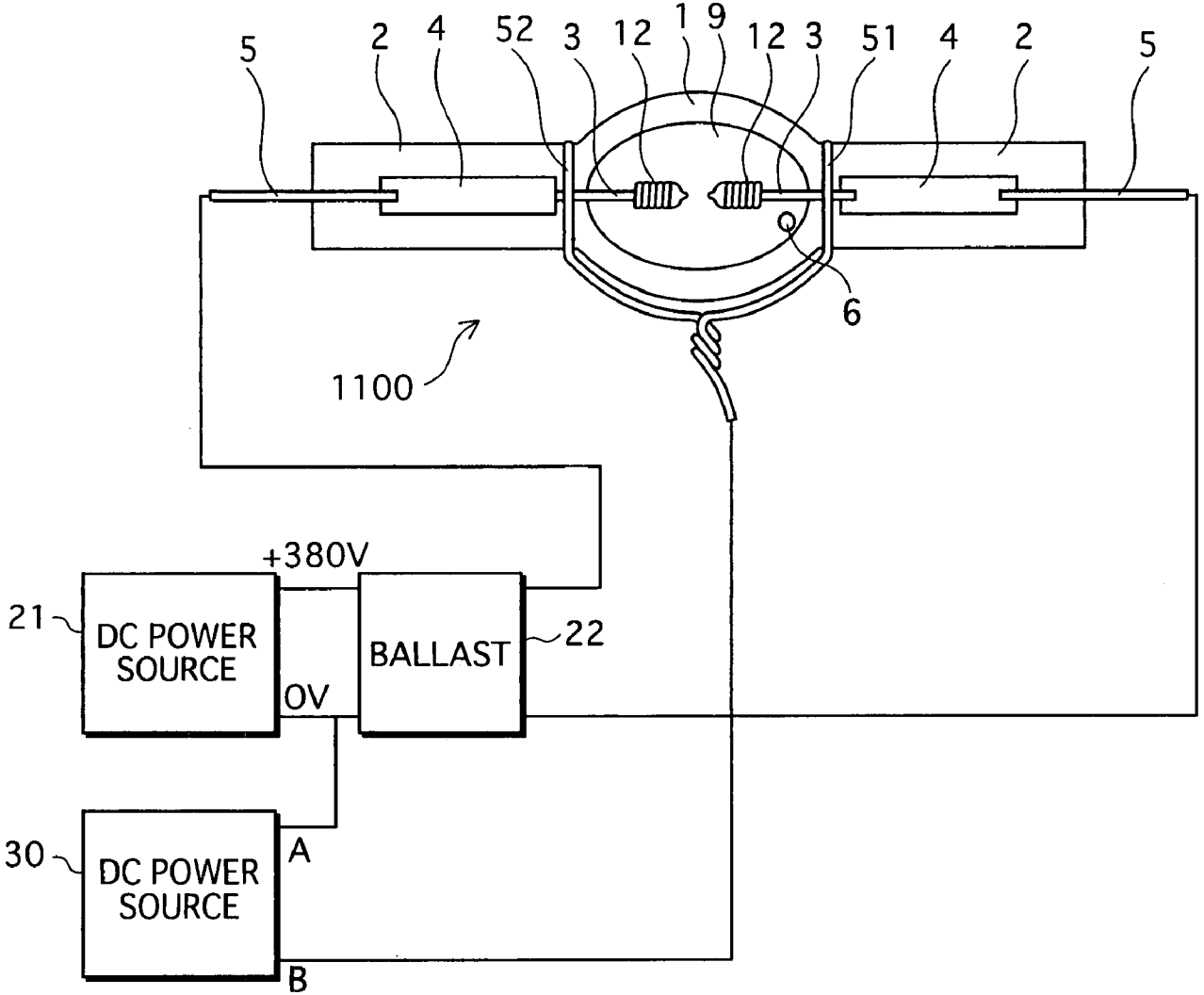
FIG. 23 is a schematic view of a device that performs an electric field application step of modification 1.

FIG. 23 shows an electric field application step using the construction shown in FIG. 21A, as modification 1.

In the lamp 1100 of modification 1, the light emitting part 1 has a substantially spherical or ellipsoidal appearance, and has a maximum outside diameter of 12 mm and a maximum wall thickness of 2.7 mm to 3 mm. Meanwhile, the sealing parts 2 are each a cylinder with a diameter of 6 mm. When the light emitting part 1 is substantially ellipsoidal, the maximum outside diameter is defined in a direction of a minor axis. An inner volume of the light emitting part 1 is 0.2 cc as one example.

During lighting, the bulb wall loading of the inner wall of the light emitting part 1 is 60 W/cm$^2$ or more. For example, 140 W/cm$^2$ is typical. When the light emitting part 1 is made of quartz glass, it is preferable to limit the bulb wall loading to no more than 200 W/cm$^2$ in terms of actual use.

Mercury, a rare gas such as argon gas or xenon gas, and a halogen such as bromine are enclosed inside the light emitting part 1. An amount of mercury enclosed is preferably no less than 0.15 mg/mm$^3$ and, in terms of actual use, preferably no more than 0.35 mg/mm$^3$. An amount of rare gas enclosed is about 5 kPa to about 40 kPa. An amount of halogen enclosed is $10^{-7}$ μmol/mm$^3$ to $10^{-2}$ μmol/mm$^3$.

An electrode is formed by the electrode rod 3 and the coil 12. The electrode rod 3 contains tungsten as a major ingredient and impurities such as an alkali metal, and is 0.3 mm to 0.45 mm in diameter. The coil 12 has the same composition as the electrode rod 3, and is wound around one end of the electrode rod 3. A tip of the electrode rod 3 is partially molten together with the coil 12 to assume a substantially hemispherical solid shape. A distance between the electrodes is 0.2 mm to 5.0 mm.

Examples of impurities in the electrode rod 3 and their contents are given below:

Potassium: 10 ppm

Sodium: 20 ppm

The tubular second glass part 7 made of Vycor glass is interposed between a portion of the electrode rod 3 located in the sealing part 2 and quartz glass constituting the sealing part 2, as in the first embodiment (the second glass part 7 is not shown in FIG. 23. See FIG. 3).

A composition of the second glass part 7 in this lamp 1100 is as follows:

$SiO_2$: 96 percent by weight or more $Al_2O_3$: 0.5 percent by weight $B_2O_3$: 3.0 percent by weight $Na_2O$: 0.04 percent by weight The conductive wires 51 and 52 are each wound around a boundary portion between the light emitting part 1 and the sealing part 2 of the lamp 1100 by one turn, so as to be close to or in contact with the boundary portion. The conductive wires 51 and 52 are made of an alloy of iron, chromium, and aluminum. A line diameter of the conductive wires 51 and 52 is in a range of 0.2 mm to 0.5 mm; preferably about 0.2 mm.

Having been wound around the boundary portions between the light emitting part 1 and the sealing parts 2, the conductive wires 51 and 52 are extended along an outside surface of the light emitting part 1 which is situated below when the lamp 1100 is lit in a position where the longitudinal axis of the light emitting part 1 is substantially perpendicular to a vertical direction (this position is hereafter called a "horizontal position"), so as to be close to or in contact with the light emitting part 1. The conductive wires 51 and 52 are united by being twisted together at a position corresponding to a center of the outside surface of the light emitting part 1.

When the lamp 1100 is lit in the horizontal position, an outside surface of the light emitting part 1 that is situated above has the highest temperature. To keep the conductive wires 51 and 52 away from this outside surface, the conductive wires 51 and 52 are provided on the lower outside surface of the light emitting part 1 where the temperature is relatively low.

To conduct the electric field application step, while holding the lamp 1100 in the horizontal position, the external leads 5 are connected to the ballast 22, and the conductive wires 51 and 52 are connected to output B of the DC power source 30. One output of the DC power source 21 and output A of the DC power source 30 are connected so as to have an equal potential.

Suppose the lamp 1100 is an AC-type high-pressure mercury lamp with a rated lamp wattage of 220 W. In this case, with reference to the potential of one output of the DC power source 21 (0V), the potential of the other output of the DC power source 21 is set to +380 V, and the potential of output B of the DC power source 30 is set to no more than −50 V.

In stable lighting, the potential of the electrodes 5 varies in a range of 0 V to 100 V, and a voltage of −50 V or less is applied to the conductive wires 51 and 52, with reference to the potential of one output of the DC power source 21 (0V).

After the above preparation, the lamp 1100 is continuously lit using the ballast 22 in substantially the same condition as can be expected in actual use, while applying a voltage of −50 V or less to the conductive wires 51 and 52.

The lamp 1100 is left in this state for at least 5 minutes, preferably for at least 15 minutes, and more preferably for at least 3 to 10 hours. This period starts immediately after the application of the voltage.

During this period, the lamp 1100 is continuously lit, so that at least the light emitting part 1 is kept at a predetermined temperature such as 800° C. It should be noted here that this lighting also serves as a normal lighting test (i.e. initial lighting).

To sufficiently diffuse impurities and especially alkali metal ions existing in the discharge space into the quartz glass, it is preferable to keep at least the light emitting part 1 at 600° C. or more. In the case where the light emitting part 1 is made of quartz glass, it is also preferable to keep at least the light emitting part 1 at no more than 1100° C., to prevent the quartz glass from recrystallizing and thereby devitrifying.

After this, the lamp 1100 is cooled naturally or manually, and then the conductive wires 51 and 52 are removed to complete the lamp.

A concave reflecting mirror is attached to this lamp 1100 to form a lamp unit (see FIG. 19) (hereafter referred to as a "present invention sample"). Operational effects of the present invention sample were tested in the following way.

Blackening and devitrification on the inner wall of the light emitting part 1 of the present invention sample were checked after 300 hours of lighting and after 2000 hours of lighting. Also, an illuminance maintenance factor (%) of the present invention sample was measured after 300 hours of lighting and after 2000 hours of lighting, with reference to an illuminance after 5 hours of lighting that is set at 100%. Results are shown in table 2 in FIG. 24.

Here, the potential applied to the conductive wires 51 and 52 in the manufacturing process of the lamp 1100 was −50 V.

The illuminance maintenance factor referred to here is an average illuminance maintenance factor (%) when an image display device that uses the lamp unit (see FIG. 20) projects an image onto a 40-inch screen.

The same measurements were performed on a lamp unit (hereafter referred to as a "comparative sample") having the same construction as the present invention sample and manufactured according to the same manufacturing method as the present invention sample except that the normal lighting test was conducted without applying an electric field. Table 2 also shows results of these measurements.

The number of present invention samples and of comparative samples tested were each five.

In the case of the present invention samples, even after 2000 hours of lighting neither devitrification nor blackening was observed in the light emitting part 1 and also the illuminance maintenance factor was 74%, as shown in table 2. In the case of the comparison samples, on the other hand, after 300 hours of lighting the inner wall of the light emitting part 1 was already significantly devitrified and blackened and the illuminance maintenance factor was 85 W. By the time the lighting period reached 2000 hours, the inner temperature of the light emitting part 1 increased due to devitrification and as a result the light emitting part 1 was bulged and deformed, in all of the comparative samples.

Thus, according to the electric field application step shown in FIG. 23, a negative potential is applied to the conductive wires 51 and 52 with respect to the potential of the electrode rods 3, and as a result an electric field is generated between the electrode rods 3 and the conductive wires 51 and 52. This electric field draws impurities and especially an alkali metal contained in the discharge space in the light emitting part 1 and in the members of the lamp 1100 (e.g. the electrode rods 3, enclosed mercury bromide, and the second glass parts 7), toward the conductive wires 51 and 52. The impurities are then diffused into quartz glass and eventually released outside the light emitting part 1. This makes it possible to prevent devitrification and blackening of the quartz glass of the light emitting part 1 during use.

Also, since at least the light emitting part 1 out of the glass members of the entire lamp 1100 is kept at no less than a predetermined temperature in the electric field application step, the diffusion of alkali metal ions in the quartz glass is accelerated.

Here, the light emitting part 1 is kept at no less than the predetermined temperature by lighting the lamp 1100, with there being no need to use special heating equipment for keeping the light emitting part 1 at the predetermined temperature or more. This contributes to lower equipment cost. Also, the electric field application step can also serve as a lamp lighting test that is normally performed during manufacturing. Hence the removal of impurities can be carried out efficiently in a short time.

Also, the electric field is applied in a state where the lamp 1100 is in the horizontal position and the conductive wires 51 and 52 are close to or in contact with the boundary portions between the light emitting part 1 and the sealing parts 2. In the horizontal position, the temperature of the boundary portions is not as high as the temperature of an upper portion of the light emitting part 1. Accordingly, even if impurities and especially an alkali metal gather in the boundary portions, the alkali metal is unlikely to react chemically with the quartz glass in the boundary portions. Hence the possibility of devitrification can be reduced.

Even if the boundary portions devitrify, the degree of devitrification is too small to deform or break the quartz glass. Also, because the boundary portions are located near the bases of the electrodes, the devitrification of the boundary portions will not cause a decrease in luminous flux.

Also, since the conductive wires 51 and 52 are not located close to or in contact with the upper outside surface of the light emitting part 1, impurities, and in particular an alkali metal, is kept from gathering at the upper portion of the light emitting part 1 during use. Hence the quartz glass that constitutes the upper portion of the light emitting part 1 is kept from devitrification.

In view of this, it is desirable to put a mark indicating the upper or lower side of the lamp 1100 onto the sealing parts 2 or the like, so that in actual use the lamp 1100 is lit in the same position as in the electric field application step.

As another experiment, the illuminance maintenance factor (%) of the present invention sample was measured after 1000 hours of lighting and after 2000 hours of lighting, in each of the cases where different voltages of 0 V, −25 V, −50 V, −100 V, and −200 V were applied to the conductive wires 51 and 52. Results of the measurements are shown in table 3 in FIG. 25.

As can be seen from table 3, if the applied voltage is −50V or less, such as −50V, −100V, and −200V, the illuminance maintenance factor was 60% or more and the light emitting part 1 did not have any deformation even after 2000 hours of lighting.

When the applied voltage is above −50 V, such as −25 V, the illuminance maintenance factor was still 71% after 1000 hours of lighting, but the light emitting part 1 bulged and deformed due to devitrification by the time the lighting period reached 2000 hours.

This indicates that a voltage of −50 V or less needs to be applied to the conductive wires 51 and 52 with reference to the potential 0V of the electrode, in order to sufficiently remove impurities and especially an alkali metal in the manufacturing process.

In the example of FIG. 23, an alloy of iron, chromium, and aluminum is used to form the conductive wires 51 and 52. However, the same effects can be achieved by using a metal having a particularly high heat resistance such as tungsten or molybdenum. Also, the line diameter of the conductive wires 51 and 52 is not limited to the above range of 0.2 mm to 0.5 mm, as the same effects can still be achieved using a different line diameter. Furthermore, the same effects can be achieved even if the shape of the conductive wires 50 and 51 is plate-like.

In the example of FIG. 23, the lamp 1100 is continuously lit in a substantially same state as in actual use, with a potential of −50 V or less being applied to the conductive wires 51 and 52. However, there is no need to continuously light the lamp 1100 in a substantially same state as in actual use, as long as the lamp 1100 is lit so as to keep at least the light emitting part 1 at 600° C. or more.

In the example of FIG. 23, the conductive wires 51 and 52 are wound around the boundary portions between the light emitting part 1 and the sealing parts 2 on the assumption that the lamp 1100 is lit in the horizontal position. However, so long as the longitudinal axis of the lamp 1100 has an angle of 45° or more with the vertical direction, the effects described above can be achieved by winding the conductive wires 51 and 52 around the boundary portions of the light emitting part 1 and the sealing parts 2.

It should be obvious here that the conductive wires 51 and 52 is not necessarily wound around the boundary portions between the light emitting part 1 and the sealing parts 2. The conductive wires 51 and 52 can be appropriately positioned in areas to which an alkali metal is intended to be drawn, depending on factors such as a lighting direction and a temperature environment.

(1-2) Modification 2

Modification 2 relates to the electric field application step shown in FIG. 22B.

Figure 26:
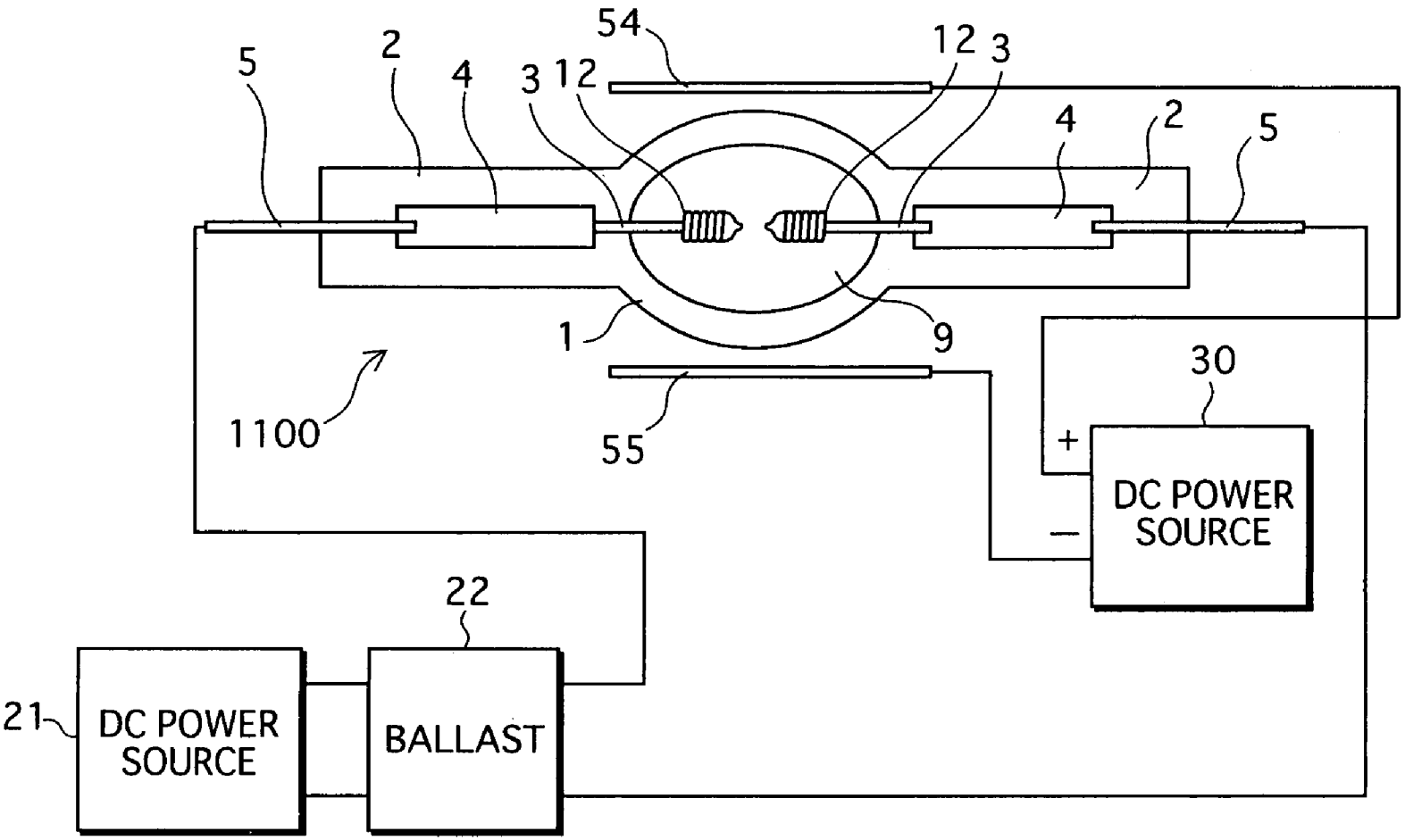
FIG. 26 is a schematic view of a device that performs an electric field application step of modification 2.

FIG. 26 shows a device for performing this electric field application step.

After forming the lamp 1100 having the same specifications as that of modification 1, the lamp 1100 is set in the horizontal position and the flat rectangular conductive plates 54 and 55 made of copper or the like are placed facing each other substantially in parallel so as to sandwich the light emitting part 1, as shown in FIG. 26.

In view of the fact that devitrification and blackening mainly occur in the light emitting part 1, the conductive plates 54 and 55 preferably cover the entire light emitting part 1. In the example of FIG. 26, a length of the conductive plates 54 and 55 in a direction of a central axis of the lamp 1100 is set substantially equal to a dimension of the light emitting part 1 in the same direction, and a width of the conductive plates 54 and 55 in a direction orthogonal to the central axis (a direction orthogonal to a paper surface of FIG. 26) is set substantially equal to a diameter of the light emitting part 1.

Different potentials are applied to the conductive plates 54 and 55. As one example, a positive potential is applied to one conductive plate, whilst a negative potential is applied to the other conductive plate. A distance between the conductive plates 54 and 55 can be set appropriately depending on the voltages applied to the conductive members 54 and 55, so as to generate a desired electric field (preferably 10 kV/m or more).

The external leads 5 of the lamp 1100 are connected to the ballast 22, and the conductive plates 54 and 55 are connected to the DC power source 30, as shown in FIG. 26.

For example, by applying a negative potential to the lower conductive plate 55 and a positive potential to the upper conductive plate 54, alkali metal ions (positive ions) which cause devitrification can be drawn toward the lower side of the light emitting part 1 which has a lower temperature than the upper side of the light emitting part 1. This further suppresses devitrification of quartz glass of the light emitting part 1.

According to the manufacturing method of modification 2, an applied electric field acts to move impurities and especially an alkali metal existing in the space in the light emitting part 1 and in the members of the lamp 1100 (e.g. the electrode rods 3, enclosed mercury bromide, and the second glass parts 7) so that the impurities are diffused into the quartz glass and released outside the light emitting part 1, as in the above embodiments and modification 1. Hence the devitrification of the quartz glass of the light emitting part 1 and the blackening of the inner wall of the light emitting part 1 during lamp use can be prevented.

Modification 2 describes the case where the flat rectangular conductive plates 54 and 55 are used, but this is not a limit for the present invention. The same effects can equally be achieved even with circular plates or plates which are curved along the outline of the light emitting part 1.

Modification 2 describes the case where the conductive plates 54 and 55 are placed at the top and bottom of the light emitting part 1, but the same effects can equally be achieved even when the conductive plates 54 and 55 are placed on the left and right sides or at the front and back of the light emitting part 1 in the posture of FIG. 26.

Modifications 1 and 2 describe the case where at least the light emitting part 1 is heated at the predetermined temperature or more by continuously lighting the lamp 1100. However, the effects described above can also be achieved when at least the light emitting part 1 is kept at the predetermined temperature or more by repeatedly turning the lamp 1100 on and off. Also, at least the light emitting part 1 may be kept at the predetermined temperature or more by heating at least the light emitting part 1 using external heating means such as a heater. Alternatively, at least the light emitting part 1 may be kept at the predetermined temperature or more by turning the lamp 1100 on and then turning it off, and subsequently heating at least the light emitting part 1 using the heating means.

Each of the above modifications describe the lamp 1100 having a rated lamp wattage of 220 W as one example, but the present invention is equally applicable to a high pressure mercury lamp having a rated lamp wattage of 150 W and to a high pressure mercury lamp having a rated lamp wattage of 250 W which exceeds 220 W.

(2) Conditions such as the Timing of the Electric Field Application Step

As described above, in the case of heating the light emitting part 1 by lighting the lamp 1100, it is desirable to perform the electric field application step at the time of initial lighting. Initial lighting (aging) is an essential process that needs to be performed prior to shipment. By performing the electric field application step during this initial lighting, the total manufacturing time can be saved.

In the case of heating the light emitting part 1 using a heating furnace or the like, it is desirable to perform the electric filed application step before initial lighting. This is because if initial lighting is performed first, impurities in the discharge space would cause blackening and devitrification.

An electric field needs to be applied for at least 5 minutes. Preferably, the electric field is applied for at least 2 hours. There is no specific upper limit to the period of applying the electric field, so long as blackening and devitrification are sufficiently suppressed. Hence the upper limit to the period of applying the electric field can be determined depending on factors such as the strength of the electric field and the heating temperature, while also taking the manufacturing cost into account.

Though it is preferable to perform the electric field application step before the initial lighting, this does not mean the initial lighting must not precede the electric field application step. In fact, when the electric field application step was conducted on a lamp which has blackened due to impurities, Na was removed. The lamp was then lit for several hours to several tens of hours, as a result of which the blackening disappeared.

Also, the effects of the present invention can be achieved so long as at least the light emitting part 1 is heated. It is desirable to perform the heating at no less than a temperature (600° C.) that is necessary for most impurities in the discharge space to ionize. If the light emitting part 1 is made of quartz glass, an upper limit of the heating temperature is 1100° C. to prevent the quartz glass from recrystallization.

The above embodiments describe the case where impurities are ionized by a high temperature, but the impurities may be ionized by other means. For example, the impurities may be ionized by applying an extremely large electric field.

Figure 27:
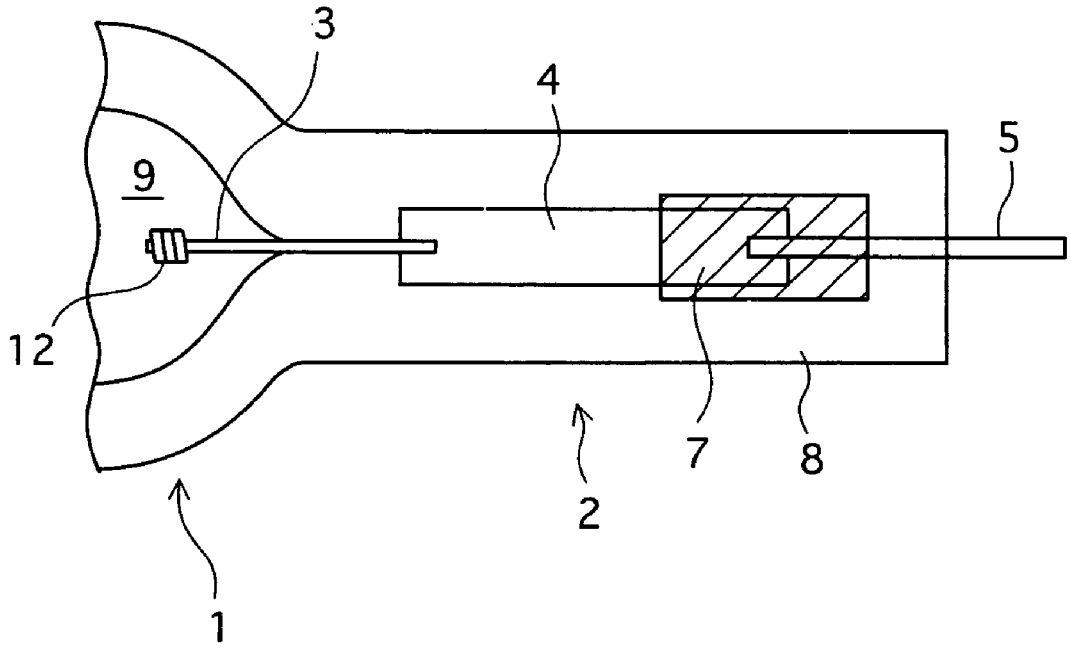
FIG. 27 shows an example of providing a second glass part 7 at another location in the sealing part 2.
Figure 28:
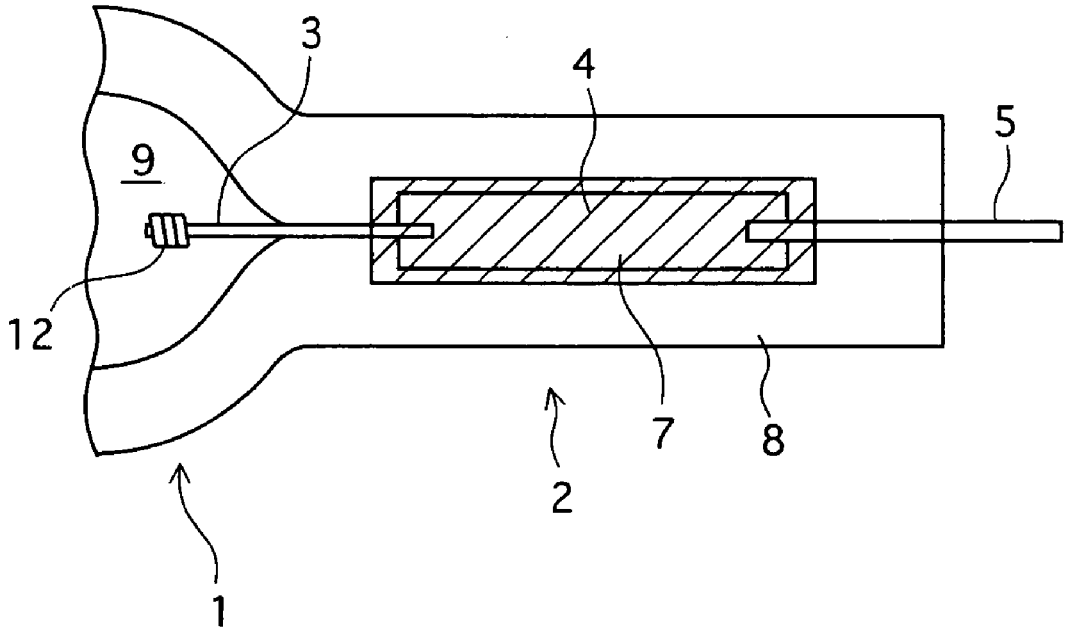
FIG. 28 shows an example of providing the second glass part 7 so as to cover an entire metal foil sheet 4.

(3) Modifications on the Lamp Construction (3-1) The above embodiments describe the case where the second glass part 7 is provided so as to cover a portion of the metal foil sheet 4 that is connected with the electrode rod 3, but the present invention is not limited to this. For example, the second glass part 7 may be provided so as to cover one end of the metal foil sheet 4 that is connected with the external lead 5, as shown in FIG. 27. Alternatively, the second glass part 7 may be provided so as to cover the entire metal foil sheet 4, as shown in FIG. 28. To enhance the pressure resistance strength, the construction shown in FIG. 28 is preferable. In view of component costs and the fact that the material of the second glass part 7 contains a large amount of impurities, however, it is desirable to form the second glass part 7 as small as possible. Also, since the sealing part 2 is more likely to be cracked near the discharge space due to the influence of heat generated by discharge, it is desirable to provide the second glass part 7 so as to cover only one portion of the metal foil sheet 4, i.e. the portion connected with the electrode rod 3, as shown in FIG. 3.

Also, even if the second glass part 7 does not cover all around the corresponding portion of the metal foil sheet 4, a certain degree of compressive stress that would suppress the stress of the metal foil sheet 4 can be attained. In such a case, a glass tube which has a C-shaped cross section can be used instead of the glass tube 70 (shown in FIG. 7), in the lamp formation step.

As mentioned earlier, the second glass part 7 has a lower softening point than the first glass part 8 to generate a compressive stress in the sealing part 2. At least one of $Al_2O_3$ and B is used as an additive for lowering the softening point of silica ($SiO_2$). If an excessive amount of such an additive is used, the softening point may become too low to produce an adequate compressive stress. Also, an excessively large amount of impurities may enter into the discharge space. Accordingly, $SiO_2$ is preferably in a range of 70 percent by weight to less than 99 percent by weight, $Al_2O_3$ is preferably no more than 15 percent by weight, and B is preferably no more than 4 percent by weight.

(3-2) The above embodiments describe the case where the second glass part 7 made of Vycor glass is provided in the sealing part 2 to enhance the pressure resistance strength, but a functional gradient material member may be used instead of Vycor glass, as follows.

Figure 29:
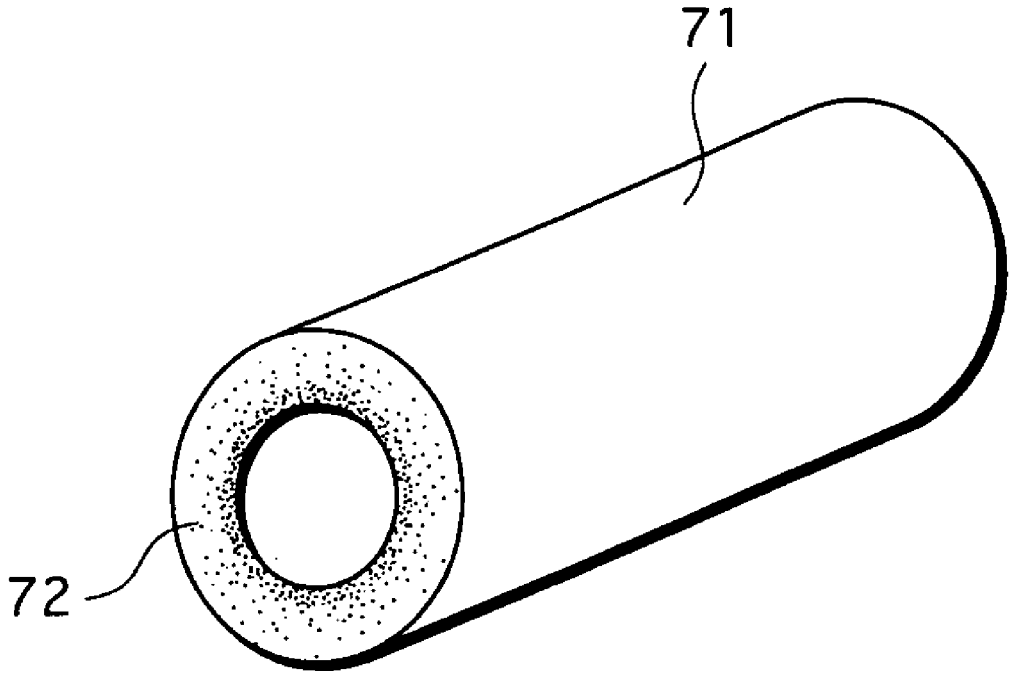
FIG. 29 is a perspective view of a gradient material tube used instead of a Vycor glass tube, according to a modification.

In the lamp formation step, a tube (hereafter "gradient material tube") 71 shown in FIG. 29, which has a substantial same dimension as the glass tube 70 made of Vycor glass shown in FIG. 7 but is made of a functionally gradient material, is inserted into the side tube part to form the sealing part 2, instead of the glass tube 70. For example, the gradient material tube 71 is formed by heating a mixture of a quartz powder and a metal powder 72 such as molybdenum or tungsten, so that an inner portion of the gradient material tube 71 has a larger content of the metal powder 72.

Such a gradient material tube 71 has a thermal expansion coefficient which is larger than that of the first glass part 8 but smaller than that of the metal foil sheet 4. Also, the thermal expansion coefficient of the gradient material tube 71 is gradually changed from its inner to outer portions such that the thermal expansion coefficient in the inner portion is close to that of the metal foil sheet 4 and the thermal expansion coefficient in the outer portion is close to that of the first glass part 8.

Thus, the gradient material tube 71 has a gradually changing thermal expansion coefficient. This makes it possible to reduce a thermal stress that is generated between adjacent members of the sealing part 2 due to a rapid temperature change (thermal shock) of the light emitting part 1 when turning the lamp 1100 on or off. Accordingly, cracking is suppressed, and the pressure resistance strength in the sealing part 2 is greatly enhanced.

Such a gradient material tube 71 may be provided at one end of the metal foil sheet 4 that is connected with the electrode rod 3, or at the position shown in FIG. 27 or 28, like the second glass part 7 made of Vycor glass.

This modification describes the case where the gradient material tube has a thermal expansion coefficient that substantially continuously varies from the inner to outer portions, but the gradient material tube may instead be formed in a multilayer structure in which each layer has a different thermal expansion coefficient.

Figure 30:
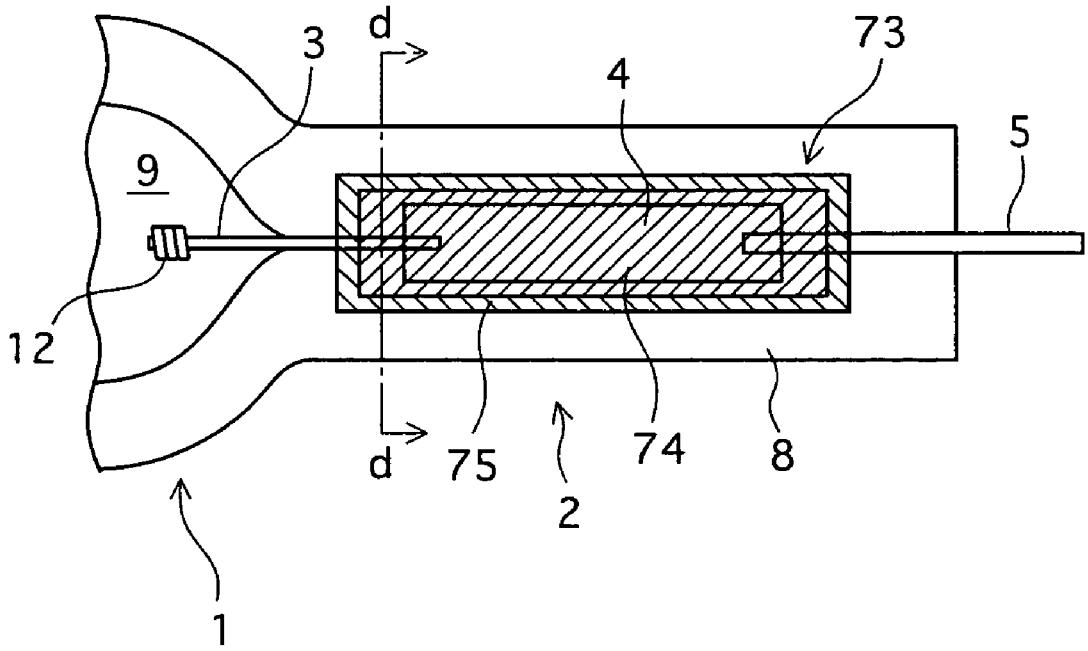
FIG. 30 is a representation of a sealing structure in which the gradient material tube is composed of two layers.

FIG. 30 shows a construction of the sealing part 2 having a gradient material tube which is made up of two layers, as one example.

Figure 31:
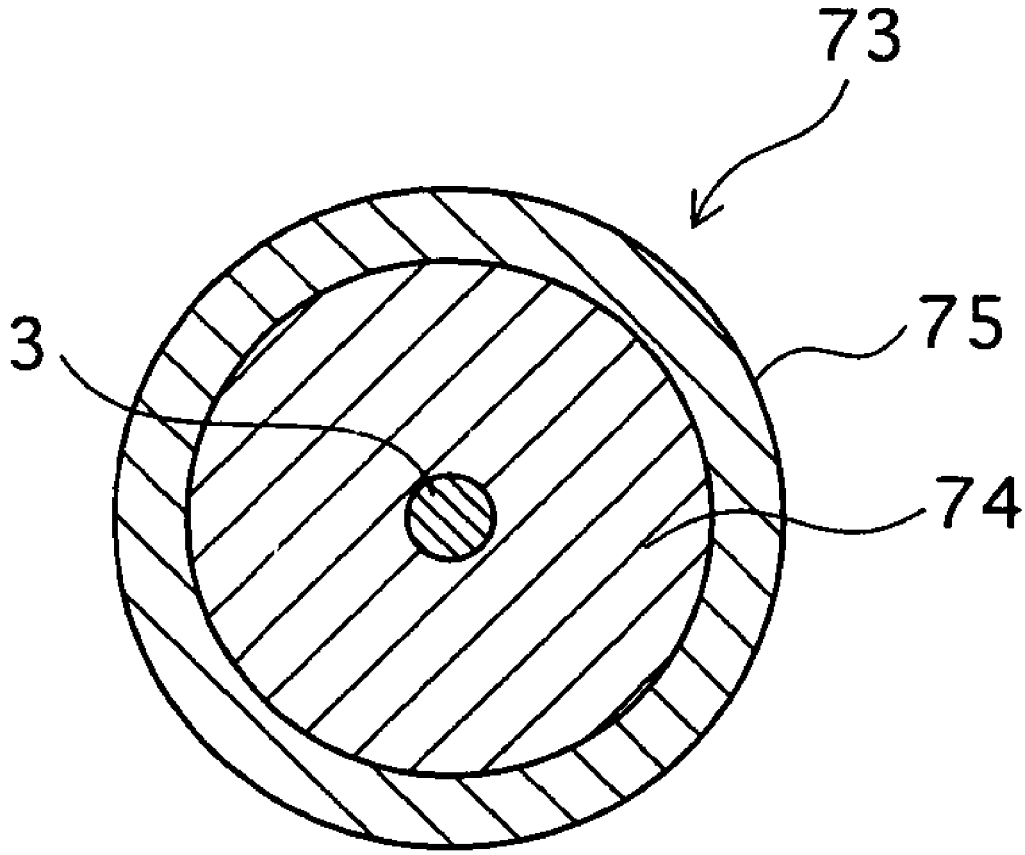
FIG. 31 is a fragmentary sectional view of the gradient material tube taken along line d-d given in FIG. 30.

In FIG. 30, a two-layer gradient material tube 73 is provided so as to cover the entire metal foil sheet 4. FIG. 31 is a fragmentary section of the gradient material tube 73 taken along line d-d given in FIG. 30. As illustrated, the gradient material tube 73 is made up of a layer 74 of a first material and a layer 75 of a second material. Let K1, K2, K3, and K4 be thermal expansion coefficients of the metal foil sheet 4, the first material, the second material, and the first glass part 8, respectively. Then the first material and the second material are selected such that K1>K2>K3>K4. For instance, two types of materials obtained by mixing different amounts of metal powder to silica may be used as the first material and the second material. Though the gradient material tube having such a multilayer structure covers the entire metal foil sheet 4 in FIG. 30, the gradient material tube may instead be provided so as to cover only one portion of the metal foil sheet 4 in the longitudinal direction.

A lamp which uses functionally gradient material members in the sealing parts has a high possibility of impurities entering into the discharge space during manufacturing. By performing the electric field application step, such impurities can be removed from the discharge space, with it being possible to suppress blackening and devitrification.

(3-3) The above embodiments and modifications describe the case where the second glass part or the functionally gradient material member is interposed between the first glass part and one portion of the metal foil sheet 4 or the whole metal foil sheet 4. When a different type of electrode structure is used, the second glass part or the functionally gradient material member is interposed between the first glass part and one portion of a feeder or the whole feeder located in the sealing part 2, instead of the metal foil sheet. In this case, the feeder may be an electrode rod itself.

(3-4) Though not illustrated, metal plating may be formed on a surface of at least one portion of the electrode located in the sealing part. By doing so, small cracking in the glass that surrounds the electrode rod 3 can be prevented. At least one metal selected from the group consisting of Pt, Ir, Rh, Ru, and Re is used for such metal plating. For secure adhesion with the electrode rod 3, it is preferable to form an Au layer first and then plate the Au layer with Pt or the like.

If the electrode rod 3 in the sealing part 2 is not metal-plated, the following problem may arise. In the sealing part formation of the lamp formation step, the glass which forms the sealing part 2 and the electrode rod 3 adhere to each other and, when cooled later, separate from each other due to a difference in thermal expansion coefficient. At this time, cracking occurs in the quartz glass around the electrode rod 3. Such cracking causes a lower pressure resistance strength than that of an ideal lamp which has no cracks.

If the metal plating is formed on the surface of the buried portion of the electrode rod 3, wettability between the quartz glass of the sealing part 2 and the surface (e.g. a Pt layer) of the electrode rod 3 decreases, since a combination of quartz glass and platinum has lower wettability than a combination of quartz glass and tungsten. Accordingly, the quartz glass and the electrode rod 3 become more separable from each other. Due to such low wettability between the electrode rod 3 and the quartz glass, the electrode rod 3 and the quartz glass more easily separate from each other during cooling which follows heating. As a result, the formation of small cracks is suppressed, making it possible to enhance the pressure resistance strength.

Even if impurities enter into the light emitting part 1 as a result of metal-plating the electrode rod 3, such impurities can be removed in the electric field application step.

(3-5) The above embodiments describe a manufacturing method for a double-end high pressure mercury lamp. However, the manufacturing method of the present invention can equally be applied to a single-end high pressure mercury lamp. Also, the manufacturing method of the present invention is not limited to high pressure mercury lamps, and is equally applicable to high pressure discharge lamps in general, that have a sealing part and experience an increase in inner pressure when lit, such as a xenon lamp and a halogen lamp.

In particular, the method of removing impurities from a glass pipe before sealing, such as the one shown in FIG. 18, is applicable not only to a glass pipe used for a high pressure mercury lamp, but also to, for example, a glass member used for a metal halide lamp or an electric bulb and a glass member used for a plasma display or a liquid crystal display.

In other words, the manufacturing method of the present invention is applicable to any discharge lamp and any display panel which can be blackened or devitrified as a result of impurities such as hydrogen and an alkali metal (potassium, lithium, or sodium) entering into a light emitting part, and which utilize a discharge effect.

INDUSTRIAL APPLICABILITY

According to the present invention, impurities, such as hydrogen and an alkali metal, that are contained in a discharge space inside a light emitting part and in glass that forms the light emitting part in a high pressure discharge lamp can be reduced. Hence the present invention is suitable as a manufacturing method of a high pressure discharge lamp having a long life and a high output that is kept from blackening and devitrification.

The invention claimed is:

1. A method for manufacturing a high pressure discharge lamp that includes: a light emitting part which is formed from glass, a pair of electrodes provided in an internal space of the light emitting part, and a light emitting material enclosed in the internal space of the light emitting part; and sealing parts which keep the internal space of the light emitting part airtight by sealing therein a pair of feeders, which are connected to the pair of electrodes, respectively, the method comprising:

sealing the pair of feeders in the sealing parts, respectively, the sealing parts each comprising a second member interposed between a first member and a feeder so as to surround at least one portion of the feeder; and applying an electric field from outside the light emitting part to the light emitting part, while keeping the light emitting part at no lower than a temperature that is required for impurities existing in the internal space of the light emitting part to ionize, so as to cause the impurities to diffuse into the glass which forms the light emitting part, wherein the electric field has a strength of 10 kV/m or more.

2. The method of claim 1, wherein the glass that forms the light emitting part is quartz glass, and wherein the step of applying the electric field comprises keeping at least the light emitting part in a temperature range of 600° C. to 1100° C.

3. The method of claim 1, wherein the second member has a lower softening point than the first member.

4. The method of claim 3, wherein the first member contains at least 99 percent by weight $SiO_2$, and the second member contains less than 99% by weight $SiO_2$ but at least 70% by weight $SiO_2$.

5. The method of claim 3, wherein the second member contains at least one of $Al_2O_3$ and boron and wherein the second member contains a $Al_2O_3$ content of no more than 15% by weight, and the second member contains a boron content of no more than 4% by weight.

6. The method of claim 1, wherein the second member has a thermal expansion coefficient that is smaller than a thermal expansion coefficient of the pair of feeders but larger than a thermal expansion coefficient of the first member.

7. The method of claim 6, wherein the thermal expansion coefficient of each of the second members decreases continuously or stepwise in a direction from the respective feeder to the first member.

8. The method of claim 1, wherein the light emitting material comprises mercury in a range of 230 mg/cc to 500 mg/cc.

9. The method of claim 1, wherein the step of applying the electric field comprises keeping at least the light emitting part at no lower than a predetermined temperature by lighting the high pressure discharge lamp.

10. The method of claim 1, wherein the step of applying the electric field comprises keeping at least the light emitting part at no lower than a predetermined temperature by heating the high pressure discharge lamp in a heating furnace.

11. The method of claim 1, wherein the step of applying the electric field comprises applying the electric field to at least the light emitting part by generating a potential difference between a conductive member provided outside the light emitting part and the pair of electrodes in the internal space of the light emitting part.

12. The method of claim 11, wherein the conductive member is a conductive wire wound around the sealing part.

13. The method of claim 11, wherein the conductive member is a metal plate that is positioned facing at least the light emitting part.

14. The method of claim 11, wherein the conductive member is a metal rod that is positioned facing at least the light emitting part.

15. The method of claim 11, wherein the step of applying the electric field comprises applying a potential to the conductive member outside the light emitting part which is lower than a potential applied to the pair of electrodes.

16. The method of claim 1, wherein the step of applying the electric field comprises applying the electric field to at least the light emitting part by placing the light emitting part between two metal plates and generating a potential difference between the two metal plates.

17. The method of claim 1, wherein the step of applying the electric field comprises applying the electric field for no less than five minutes.

18. The method of claim 1, wherein the step of applying the electric field is performed before initial lighting or at initial lighting.

19. A method for manufacturing, by processing a glass pipe, a high pressure discharge lamp that includes: a light emitting part which is formed from glass, a pair of electrodes provided in an internal space of the light emitting part, and a light emitting material enclosed in the internal space of the light emitting part; and sealing parts which keep the internal space of the light emitting part airtight by sealing therein a pair of feeders, which are connected to the pair of electrodes, respectively, the method comprising:

applying an electric field, before the sealing part is formed in the glass pipe, to at least a portion of the glass pipe that is to be formed into the light emitting part, while keeping at least the portion of the glass pipe at no lower than a temperature that is required for impurities included in the portion of the glass pipe to ionize, the electric field acting from outside the portion of the glass pipe; and sealing the pair of feeders in the sealing parts, respectively, the sealing parts each comprising a second member interposed between a first member and a feeder so as to surround at least one portion of the feeder.

20. A method for manufacturing a high pressure discharge lamp that includes: a light emitting part which is formed from glass, a pair of electrodes provided in an internal space of the light emitting part, and a light emitting material enclosed in the internal space of the light emitting part; and sealing parts which keep the internal space of the light emitting part airtight by sealing therein a pair of feeders, which are connected to the pair of electrodes, respectively, the method comprising:

sealing the pair of feeders in the sealing parts, respectively, the sealing parts each comprising a second member interposed between a first member and a feeder so as to surround at least one portion of the feeder; and applying an electric field from outside the light emitting part to the light emitting part, while keeping the light emitting part at no lower than a temperature that is required for impurities existing in the internal space of the light emitting part to ionize, so as to cause the impurities to diffuse into the glass which forms the light emitting part, wherein the electric field is applied for no less than five minutes.

* * * * *